US008035315B2

(12) United States Patent
Zhao et al.

(10) Patent No.: US 8,035,315 B2
(45) Date of Patent: Oct. 11, 2011

(54) LED DRIVER WITH FEEDBACK CALIBRATION

(75) Inventors: Bin Zhao, Irvine, CA (US); Jack W. Cornish, Foothill Ranch, CA (US); Brian B. Horng, Irvine, CA (US); Andrew M. Kameya, Irvine, CA (US); Jan Krellner, Chandler, AZ (US); Kenneth C. Kwok, Irvine, CA (US); Victor K. Lee, Irvine, CA (US); Weizhuang W. Xin, Aliso Viejo, CA (US)

(73) Assignee: Freescale Semiconductor, Inc., Austin, TX (US)

( * ) Notice: Subject to any disclaimer, the term of this patent is extended or adjusted under 35 U.S.C. 154(b) by 442 days.

(21) Appl. No.: 12/340,985

(22) Filed: Dec. 22, 2008

(65) Prior Publication Data

US 2010/0156315 A1 Jun. 24, 2010

(51) Int. Cl.
*H05B 37/02* (2006.01)
*G09G 5/00* (2006.01)

(52) U.S. Cl. ..... 315/299; 315/308; 315/312; 315/360; 345/204

(58) Field of Classification Search ..... 315/185 R, 315/185 S, 209 R, 210, 224, 225, 226, 246, 315/247, 291, 294, 299, 302, 307, 308, 312, 315/324, 360; 345/204, 214, 82
See application file for complete search history.

(56) References Cited

U.S. PATENT DOCUMENTS 3,973,197 A 8/1976 Meyer
4,162,444 A 7/1979 Rodgers
4,615,029 A 9/1986 Hu et al.
4,649,432 A 3/1987 Watanabe et al.
4,686,640 A 8/1987 Simison
5,025,176 A 6/1991 Takeno
5,038,055 A 8/1991 Kinoshita
5,455,868 A 10/1995 Sergent et al.
5,508,909 A 4/1996 Maxwell et al.
5,635,864 A 6/1997 Jones
5,723,950 A 3/1998 Wei et al.

(Continued)

FOREIGN PATENT DOCUMENTS

JP 2003332624 A 11/2003

(Continued)

OTHER PUBLICATIONS

Mc Nerney, Tim, "Constant-current power supply for Luxeon 5W LED with low-voltage warning and shut-off Software Documentation, as shipped to Mali in first 45 prototypes," Nov. 2004, www.designthatmatters.org/ke/pubs/kled-doc.txt, 5 pages.

(Continued)

*Primary Examiner* — Thuy Vinh Tran

(57) ABSTRACT

Power management in a light emitting diode (LED) system having a plurality of LED strings is disclosed. A voltage source provides an output voltage to drive a plurality of LED strings. An LED driver implements a feedback mechanism to monitor the tail voltages of the active LED strings to identify the minimum tail voltage and adjust the output voltage of the voltage source based on the lowest tail voltage. A loop calibration module of the LED driver calibrates the feedback mechanism of the LED driver based on a relationship between a digital code value used to generate a particular output voltage and another digital code value generated based on the minimum tail voltage resulting from the particular output voltage.

20 Claims, 9 Drawing Sheets

U.S. PATENT DOCUMENTS

| | | | | |
|---|---|---|---|---|
| 6,002,356 | A | 12/1999 | Cooper | |
| 6,281,822 | B1 | 8/2001 | Park | |
| 6,373,423 | B1 | 4/2002 | Knudsen | |
| 6,636,104 | B2 | 10/2003 | Henry | |
| 6,822,403 | B2 | 11/2004 | Horiuchi et al. | |
| 6,864,641 | B2 | 3/2005 | Dygert | |
| 6,943,500 | B2 | 9/2005 | LeChevalier | |
| 7,262,724 | B2 | 8/2007 | Hughes et al. | |
| 7,307,614 | B2 | 12/2007 | Vinn | |
| 7,315,095 | B2 | 1/2008 | Kagemoto et al. | |
| 7,391,280 | B2 | 6/2008 | Hsu | |
| 7,436,378 | B2 | 10/2008 | Ito et al. | |
| 7,459,959 | B2 | 12/2008 | Rader et al. | |
| 7,511,545 | B1 | 3/2009 | Kesler | |
| 7,696,915 | B2 | 4/2010 | Chmelar et al. | |
| 7,777,704 | B2 * | 8/2010 | S et al. | 345/82 |
| 7,825,610 | B2 * | 11/2010 | Zhao et al. | 315/299 |
| 7,973,495 | B2 | 7/2011 | Ion et al. | |
| 2004/0208011 | A1 | 10/2004 | Horiuchi et al. | |
| 2004/0233144 | A1 | 11/2004 | Rader et al. | |
| 2006/0164162 | A1 | 7/2006 | Dauphinee et al. | |
| 2006/0186830 | A1 | 8/2006 | Shami et al. | |
| 2006/0261895 | A1 | 11/2006 | Kocaman et al. | |
| 2007/0080911 | A1 | 4/2007 | Liu et al. | |
| 2007/0253330 | A1 | 11/2007 | Tochio et al. | |
| 2008/0054815 | A1 | 3/2008 | Kotikalapoodi | |
| 2008/0297067 | A1 | 12/2008 | Wang et al. | |
| 2009/0108775 | A1 | 4/2009 | Sandner et al. | |
| 2009/0128045 | A1 | 5/2009 | Szczeszynski et al. | |
| 2009/0187925 | A1 | 7/2009 | Hu et al. | |
| 2009/0230874 | A1 * | 9/2009 | Zhao et al. | 315/192 |
| 2009/0230891 | A1 | 9/2009 | Zhao et al. | |
| 2009/0273288 | A1 * | 11/2009 | Zhao et al. | 315/185 R |
| 2009/0315481 | A1 | 12/2009 | Zhao | |
| 2010/0013395 | A1 * | 1/2010 | Archibald et al. | 315/185 R |
| 2010/0013412 | A1 * | 1/2010 | Archibald et al. | 315/294 |
| 2010/0026203 | A1 * | 2/2010 | Zhao et al. | 315/291 |
| 2010/0085295 | A1 | 4/2010 | Zhao et al. | |
| 2010/0134040 | A1 * | 6/2010 | Elder | 315/294 |
| 2010/0156315 | A1 | 6/2010 | Zhao et al. | |

FOREIGN PATENT DOCUMENTS

| | | | |
|---|---|---|---|
| JP | 2005116199 | A | 4/2005 |
| KR | 1020070082004 | A | 8/2007 |
| WO | 2005022596 | A2 | 3/2005 |

OTHER PUBLICATIONS

Maxim: "Application Note 810, Understanding Flash ADCs," Oct. 2, 2001, 8 pages.
National Semiconductor Data Sheet: "LM3432/LM3432B 6-Channel Current Regulator for LED Backlight Application," May 22, 2008, pp. 1-18.
U.S. Appl. No. 12/537,443, filed Aug. 7, 2009, entitled Pulse Width Modulation Frequency Conversion.
U.S. Appl. No. 12/703,239, filed Feb. 10, 2010, entitled "Pulse Width Modulation With Effective High Duty Resolution".
U.S. Appl. No. 12/537,692, filed Aug. 7, 2009, entitled "Phase-Shifted Pulse Width Modulation Signal Generation".
U.S. Appl. No. 12/625,818, filed Nov. 25, 2009, entitled "Synchronized Phase-Shifted Pulse Width Modulation Signal Generation".
U.S. Appl. No. 12/703,249, filed Feb. 10, 2010, entitled "Duty Transition Control in Pulse Width Modulation Signaling".
Luke Huiyong Chung, Electronic Products: "Driver ICs for LED BLUs," May 1, 2008, 3 pages.
Akira Takahashi, Electronic Products: "Methods and features of LED drivers," Mar. 2008, 3 pages.
International Application No. PCT/US2009/035284, Search Report and Written Opinion, Oct. 28, 2009, 11 pages.
U.S. Appl. No. 12/326,963, filed Dec. 3, 2008, entitled "LED Driver With Precharge and Track/Hold".
U.S. Appl. No. 12/367,672, filed Feb. 9, 2009, entitled "Configuration for Dynamic Power Control in LED Displays".
U.S. Appl. No. 12/424,326, filed Apr. 15, 2009, entitled "Peak Detection With Digital Conversion".
U.S. Appl. No. 12/504,841, filed Jul. 17, 2009, entitled "Analog-To-Digital Converter With Non-Uniform Accuracy".
U.S. Appl. No. 12/690,972, filed Jan. 21, 2010, entitled "Serial Cascade of Minimum Tail Voltages of Subsets of LED Strings for Dynamic Power Contrl in LED Displays".
U.S. Appl. No. 12/363,607, filed Jan. 30, 2009, entitled "LED Driver With Dynamic Headroom Control".
Texas Instruments Publication, "Interleaved Dual PWM Controller with Programmable Max Duty Cycle," SLUS544A, Sep. 2003, pp. 1-28.
PCT Application No. PCT/US2009/065913; Search Report and Written Opinion dated Jul. 7, 2010.
Non-Final Office Action mailed Apr. 19, 2011 for U.S. Appl. No. 12/363,294, 19 pages.
Non-Final Office Action mailed Apr. 19, 2011 for U.S. Appl. No. 12/363,607, 17 pages.
PCT Application No. PCT/US2010/028289; Search Report and Written Opinion dated Dec. 15, 2010.
Notice of Allowance mailed Apr. 7, 2011 for U.S. Appl. No. 12/326,963, 20 pages.
Office Action—NFOA Feb. 4, 2010, 11 pages.
Office Action—NOA Jun. 2, 2010, 7 pages.
Office Action—NOA Jul. 9, 2010, 12 pages.
Notice of Allowance mailed Jul. 19, 2011 for U.S. Appl. No. 12/424,326, 27 pages.
Notice of Allowance mailed Aug. 1, 2011 for U.S. Appl. No. 12/363,294, 11 pages.
Ex parte Quayle mailed Jul. 20, 2011 for U.S. Appl. No. 12/363,179, 25 pages.
Notice of Allowance mailed Aug. 11, 2011 for U.S. Appl. No. 12/363,607, 9 pages.

* cited by examiner

LED DRIVER WITH FEEDBACK CALIBRATION

FIELD OF THE DISCLOSURE

The present disclosure relates generally to light emitting diodes (LEDs) and more particularly to LED drivers.

BACKGROUND

Light emitting diodes (LEDs) often are used as light sources in liquid crystal displays (LCDs) and other displays. The LEDs often are arranged in parallel "strings" driven by a shared voltage source, each LED string having a plurality of LEDs connected in series. To provide consistent light output between the LED strings, each LED string typically is driven at a regulated current that is substantially equal among all of the LED strings.

Although driven by currents of equal magnitude, there often is considerable variation in the bias voltages needed to drive each LED string due to variations in the static forward-voltage drops of individual LEDs of the LED strings resulting from process variations in the fabrication and manufacturing of the LEDs. Dynamic variations due to changes in temperature when the LEDs are enabled and disabled also can contribute to the variation in bias voltages needed to drive the LED strings with a fixed current. In view of this variation, conventional LED drivers typically provide a fixed voltage that is sufficiently higher than an expected worst-case bias drop so as to ensure proper operation of each LED string. However, as the power consumed by the LED driver and the LED strings is a product of the output voltage of the LED driver and the sum of the currents of the individual LED strings, the use of an excessively high output voltage by the LED driver unnecessarily increases power consumption by the LED driver. Accordingly, an improved technique for driving LED strings would be advantageous.

BRIEF DESCRIPTION OF THE DRAWINGS

The present disclosure may be better understood, and its numerous features and advantages made apparent to those skilled in the art by referencing the accompanying drawings. The use of the same reference symbols in different drawings indicates similar or identical items.

DETAILED DESCRIPTION

FIGS. 1-14 illustrate example techniques for power management in a light emitting diode (LED) system having a plurality of LED strings. A voltage source provides an output voltage to drive the LED strings. An LED driver monitors the tail voltages of the LED strings to identify the minimum, or lowest, tail voltage and adjusts the output voltage of the voltage source based on the lowest tail voltage. In at least one embodiment, the LED driver adjusts the output voltage so as to maintain the lowest tail voltage at or near a predetermined threshold voltage so as to ensure that the output voltage is sufficient to properly drive each active LED string with a regulated current in view of pulse width modulation (PWM) timing requirements without excessive power consumption.

Further, the feedback mechanism, or feedback loop, employed by the LED driver to adjust the output voltage may be subject to deviation from an expected performance characteristic. To illustrate, the feedback loop can employ a resistor-based voltage divider to obtain a feedback voltage proportional to the output voltage. In certain instances the ratio of the resistive values implemented in the voltage divider may not match the specified resistive ratio for which the feedback loop is designed, or the actual resistive ratio may dynamically change due to thermal conditions, fatigue, and the like. Accordingly, in one embodiment, the LED driver implements a loop calibration module configured to determine a feedback compensation factor based on the deviation of the actual performance of the feedback mechanism with the expected performance and use this feedback compensation factor to calibrate the feedback mechanism accordingly.

The term "LED string," as used herein, refers to a grouping of one or more LEDs connected in series. The "head end" of a LED string is the end or portion of the LED string which receives the driving voltage/current and the "tail end" of the LED string is the opposite end or portion of the LED string.

The term "tail voltage," as used herein, refers the voltage at the tail end of a LED string or representation thereof (e.g., a voltage-divided representation, an amplified representation, etc.).

Figure 1:
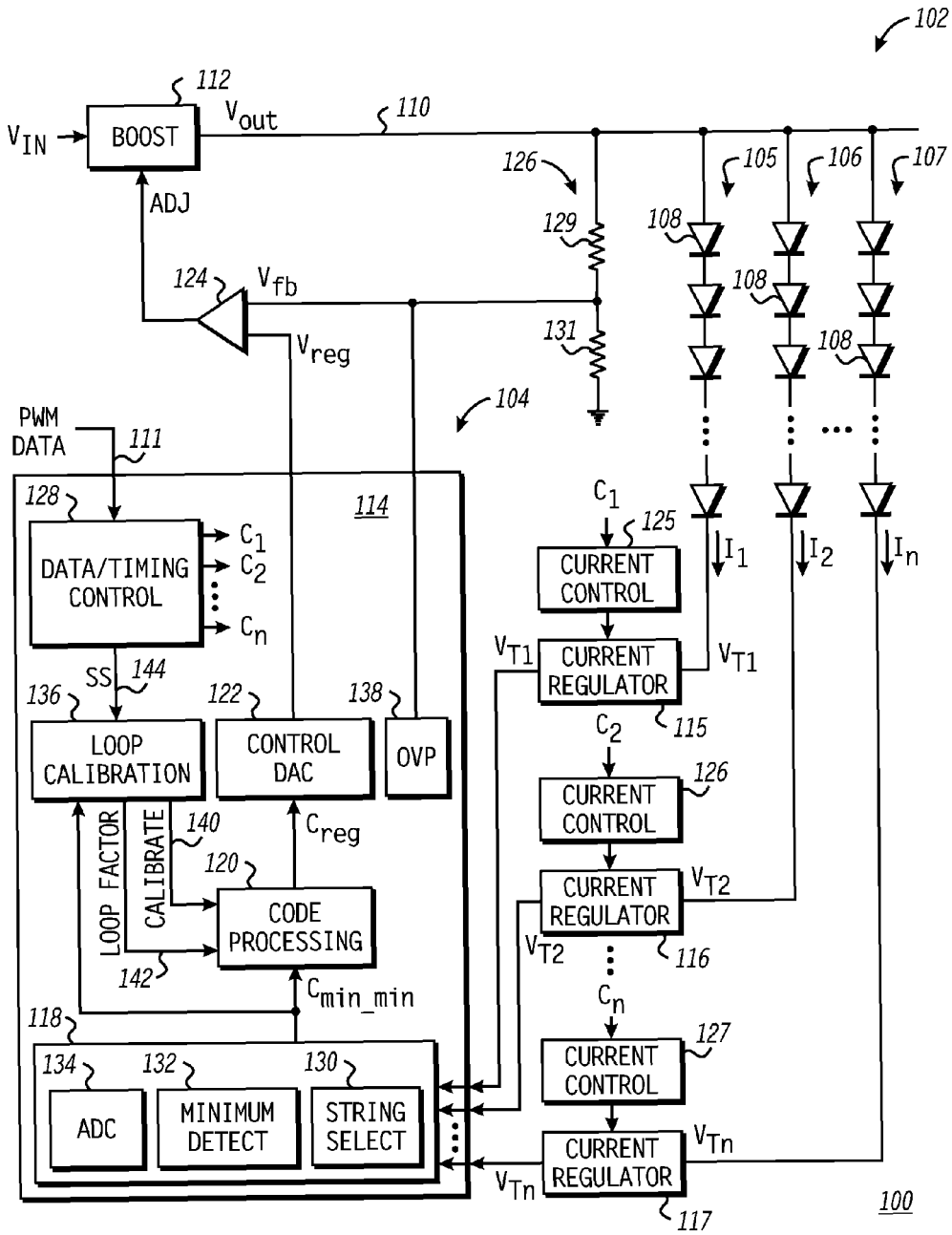
FIG. 1 is a diagram illustrating a light emitting diode (LED) system having dynamic power management utilizing a calibrated feedback mechanism in accordance with at least one embodiment of the present invention.

FIG. 1 illustrates a LED system 100 having dynamic power management in accordance with at least one embodiment of the present disclosure. In the depicted example, the LED system 100 includes a LED panel 102, a LED driver 104, and a voltage source 112 for providing an output voltage $V_{OUT}$ to drive the LED panel 102. The LED panel 102 includes a plurality of LED strings (e.g., LED strings 105, 106, and 107). Each LED string includes one or more LEDs 108 connected in series. The LEDs 108 can include, for example, white LEDs, red, green, blue (RGB) LEDs, organic LEDs (OLEDs), etc. Each LED string is driven by the adjustable voltage $V_{OUT}$ received at the head end of the LED string via a voltage bus 110 (e.g., a conductive trace, wire, etc.). In the embodiment of FIG. 1, the voltage source 112 is implemented as a boost converter configured to drive the output voltage $V_{OUT}$ using an input voltage $V_{IN}$.

The LED driver 104 includes a feedback controller 114 configured to control the voltage source 112 based on the tail voltages at the tail ends of the LED strings 105-107. As described in greater detail below, the LED driver 104, in one embodiment, receives pulse width modulation (PWM) data 111 representative of activation of certain of the LED strings 105-107 and at what times during a corresponding PWM cycle, and the LED driver 104 is configured to either collectively or individually activate the LED strings 105-107 at the appropriate times in their respective PWM cycles based on the PWM data 111.

The feedback controller 114, in one embodiment, includes a plurality of current regulators (e.g., current regulators 115, 116, and 117), a code generation module 118, a code processing module 120, a control digital-to-analog converter (DAC) 122, an error amplifier (or comparator) 124, a data/timing control module 128, and a loop calibration module (LCM) 136. The feedback controller 114 further can include an over-voltage protection (OVP) module 138 configured to monitor the output voltage $V_{OUT}$ for an over-voltage condition.

In the example of FIG. 1, the current regulator 115 is configured to maintain the current $I_1$ flowing through the LED string 105 at or near a fixed current (e.g., 30 mA) when active. Likewise, the current regulators 116 and 117 are configured to maintain the current $I_2$ flowing through the LED string 106 when active and the current $I_n$ flowing through the LED string 107 when active, respectively, at or near the fixed current. The current control modules 125, 126, and 127 are configured to activate or deactivate the LED strings 105, 106, and 107, respectively, via the corresponding current regulators.

Typically, a current regulator, such as current regulators 115-117, operates more optimally when the input of the current regulator is a non-zero voltage so as to accommodate the variation in the input voltage that often results from the current regulation process of the current regulator. This buffering voltage often is referred to as the "headroom" of the current regulator. As the current regulators 115-117 are connected to the tail ends of the LED strings 105-107, respectively, the tail voltages of the LED strings 105-107 represent the amounts of headroom available at the corresponding current regulators 115-117. However, headroom in excess of that necessary for current regulation purposes results in unnecessary power consumption by the current regulator. Accordingly, as described in greater detail herein, the LED system 100 employs techniques to provide dynamic headroom control so as to maintain the minimum tail voltage of the active LED strings at or near a predetermined threshold voltage, thus maintaining the lowest headroom of the current regulators 105-107 at or near the predetermined threshold voltage. The threshold voltage can represent a determined balance between the need for sufficient headroom to permit proper current regulation by the current regulators 105-107 and the advantage of reduced power consumption by reducing the excess headroom at the current regulators 105-107.

The code generation module 118 includes a plurality of tail inputs coupled to the tail ends of the LED strings 105-107 to receive the tail voltages $V_{T1}$, $V_{T2}$, and $V_{Tn}$ of the LED strings 105, 106, and 107, respectively, and an output to provide a code value $C_{min_min}$. In at least one embodiment, the code generation module 118 is configured to identify or detect the minimum, or lowest, tail voltage of the LED strings 105-107 that occurs over a PWM cycle or other specified duration and generate the digital code value $C_{min_min}$ based on the identified minimum tail voltage. In the disclosure provided herein, the following nomenclature is used: the minimum of a particular measured characteristic over a PWM cycle or other specified duration is identified with the subscript "min_min", thereby indicating it is the minimum over a specified time span; whereas the minimum of a particular measured characteristic at a given point in time or sample point is denoted with the subscript "min." To illustrate, the minimum tail voltage of the LED strings 105-107 at any given point in time or sample point is identified as $V_{Tmin}$, whereas the minimum tail voltage of the LED strings 105-107 for a given PWM cycle (having one or more sample points) is identified as $V_{Tmin_min}$. Similarly, the minimum code value determined at a given point in time or sample point is identified as $C_{min}$, whereas the minimum code value for a given PWM cycle (having one or more sample points) is identified as $C_{min_min}$.

The code generation module 118 can include one or more of a string select module 130, a minimum detect module 132, and an analog-to-digital converter (ADC) 134. As described in greater detail below with reference to FIGS. 4, 5, 8 and 9, the string select module 130 is configured to output the minimum tail voltage $V_{Tmin}$ of the LED strings 105-107 (which can vary over the PWM cycle), the ADC 134 is configured to convert the magnitude of the minimum tail voltage $V_{Tmin}$ output by the string select module 130 to a corresponding code value $C_{min}$ for each of a sequence of conversion points in the PWM cycle, the minimum detect module 132 is configured as a digital component to detect the minimum code value $C_{min}$ from the plurality of code values $C_{min}$ generated over the PWM cycle as the minimum code value $C_{min_min}$ for the PWM cycle. Alternately, as described in greater detail below with reference to FIGS. 6 and 7, the minimum detect module 132 is configured as an analog component to determine the minimum tail voltage $V_{Tmin_min}$ for the PWM cycle from the potentially varying magnitude of the voltage $V_{Tmin}$ output by the string select module 130 over the PWM cycle, and the ADC 134 is configured to perform a single conversion of the voltage $V_{Tmin_min}$ to the minimum code value $C_{min_min}$ for the PWM cycle. As another embodiment, as described in greater detail below with reference to FIGS. 10 and 11, the string select module 130 is omitted and the ADC 134 can be configured as multiple ADCs. Each ADC is configured to repeatedly convert the tail voltage of a corresponding one of the LED strings 105-107 into a series of code values $C_i$ (whereby i represents the corresponding LED string) having magnitudes representative of the magnitude of the tail voltage at the time of the conversion. In this instance, the minimum detect module 132 is configured as a digital component to determine the minimum of the code values $C_i$ generated from all of the ADCs to identify the minimum code value $C_{min_min}$ over the PWM cycle.

The code processing module 120 includes an input to receive the code value $C_{min_min}$ and an output to provide a code value $C_{reg}$ based on the code value $C_{min_min}$ and either a previous value for $C_{reg}$ from a previous PWM cycle or an initialization value. As the code value $C_{min_min}$ represents the minimum tail voltage $V_{Tmin_min}$ that occurred during the PWM cycle for all of the LED strings 105-107, the code processing module 120, in one embodiment, compares the code value $C_{min_min}$ to a threshold code value, $C_{thresh}$, and generates a code value $C_{reg}$ based on the comparison. The code processing module 120 can be implemented as hardware, software executed by one or more processors, or a combination thereof. To illustrate, the code processing module 120 can be implemented as a logic-based hardware state machine, software executed by a processor, and the like. Example implementations of the code generation module 118 and the code processing module 120 are described in greater detail with reference to FIGS. 4-11.

In certain instances, none of the LED strings 105-107 may be enabled for a given PWM cycle. Thus, to prevent an erroneous adjustment of the output voltage $V_{OUT}$ when all LED strings are disabled, in one embodiment the data/timing control module 128 signals the code processing module 120 to suppress any updated code value $C_{reg}$ determined during a PWM cycle in which all LED strings are disabled, and instead use the code value $C_{reg}$ from the previous PWM cycle.

The control DAC 122 includes an input to receive the code value $C_{reg}$ and an output to provide a regulation voltage $V_{reg}$ representative of the code value $C_{reg}$. The regulation voltage $V_{reg}$ is provided to the error amplifier 124. The error amplifier 124 also receives a feedback voltage $V_{fb}$ representative of the output voltage $V_{OUT}$. In the illustrated embodiment, a voltage divider 126 implemented by resistors 128 and 130 is used to generate the voltage $V_{fb}$ from the output voltage $V_{OUT}$. The error amplifier 124 determines the relationship between the regulation voltage $V_{reg}$ and the output voltage $V_{OUT}$ by comparing the voltage $V_{fb}$ and the voltage $V_{reg}$ and the error amplifier 124 then configures a signal ADJ based on this comparison. The voltage source 112 receives the signal ADJ and adjusts the output voltage $V_{OUT}$ based on the magnitude of the signal ADJ.

The OVP module 138 monitors the feedback voltage $V_{fb}$ to determine whether there is an over-voltage condition for the voltage $V_{OUT}$. In the event that an over-voltage condition is detected, the OVP module 138 acts to disable the voltage source 112 or otherwise reduce the magnitude of the output voltage $V_{OUT}$ so as to prevent damage to the LED driver 104.

As described above, there may be considerable variation between the voltage drops across each of the LED strings 105-107 due to static variations in forward-voltage biases of the LEDs 108 of each LED string and dynamic variations due to the on/off cycling of the LEDs 108. Thus, there may be significant variance in the bias voltages needed to properly operate the LED strings 105-107. However, rather than drive a fixed output voltage $V_{OUT}$ that is substantially higher than what is needed for the smallest voltage drop as this is handled in conventional LED drivers, the LED driver 104 illustrated in FIG. 1 utilizes a feedback mechanism that permits the output voltage $V_{OUT}$ to be adjusted so as to reduce or minimize the power consumption of the LED driver 104 in the presence of variances in voltage drop across the LED strings 105-107, as described below with reference to the methods 200 and 300 of FIG. 2 and FIG. 3, respectively. For ease of discussion, the feedback duration of this mechanism is described in the context of a PWM cycle-by-PWM cycle basis for adjusting the output voltage $V_{OUT}$. However, any of a variety of cycle durations may be used for this feedback mechanism without departing from the scope of the present disclosure. To illustrate, the feedback duration could encompass a portion of a PWM cycle, multiple PWM cycles, a duration of a certain number of clock cycles, a duration between interrupts, a duration related to video display, such as a video frame or a portion thereof, and the like.

The feedback mechanism of the LED driver 104 relies on the feedback voltage $V_{fb}$ in determining whether to adjust the output voltage $V_{OUT}$. As illustrated by the embodiment of FIG. 1, this adjustment decision is made based on the relationship between the feedback voltage $V_{fb}$ (representing the output voltage $V_{OUT}$) and the voltage $V_{reg}$ generated by the feedback loop implemented via the ADC 134, the code processing module 120, and the control DAC 122. The feedback voltage $V_{fb}$, in one embodiment, is generated via the voltage divider 126 and thus the ratio of the feedback voltage $V_{fb}$ and the output voltage $V_{OUT}$ is determined by the particular ratio of the resistive values of the resistors 128 and 130 of the voltage divider 126. In an effort to ensure correct operation of the feedback mechanism, a particular resistive ratio (or particular resistive values) may be specified for the resistors 128 and 130 and the gains and other operating characteristics of the ADC 134, the code processing module 120, and the control DAC 122 may be configured based on the specified resistive values or the specified resistive ratio. In implementation, however, the actual resistive values for resistors 128 and 130, or the ratio thereof, may differ from the specified or expected resistive values/ratio. To illustrate, the OVP module 138 may use the feedback voltage $V_{fb}$ as the monitored representation of the output voltage $V_{OUT}$. A manufacturer or provider of the LED system 100 therefore may tailor the resistive ratio of the voltage divider 126 particularly for the over-voltage protection process of the OVP module 138 and the resulting resistive ratio may not be consistent with the specified resistive ratio for purposes of the feedback mechanism. As another example, the resistive ratio may dynamically change due to thermal conditions, degradation of the resistors 128 and 130 over time, and the like.

The deviation of the resistive ratio of the voltage divider 126 from the specified or expected resistive ratio can result in sub-optimal performance of the feedback mechanism because the ADC 134, the code-processing module 120 and the control DAC 122 typically are configured in view of the specified or expected resistive ratio. Accordingly, the LCM 136, in one embodiment, calibrates the feedback mechanism by determining the deviation of the actual performance of the feedback mechanism from the expected performance and adjusting the feedback mechanism accordingly so as to compensate for the difference between the actual resistive ratio of the voltage divider 126 and the expected or specified resistive ratio. This calibration process also can compensate for other unexpected deviations, such as circuit aging, deviations in the accuracies of the DACs and ADCs described herein, and the like.

As described in greater detail below, the calibration process performed by the LCM 136 includes stimulating the feedback mechanism with a predetermined stimulus, observing the actual response of the feedback mechanism, and then comparing the actual response with an expected response. To initiate this process, the LCM 136 asserts a calibrate signal 140, in response to which the code processing module 120 increases the current value of the code $C_{reg}$ by a predetermined amount (e.g., by a value of 5 or 10 for an 8-bit code value). This increase in the value of the code $C_{reg}$ triggers the control DAC 122 to increase the value of the voltage $V_{reg}$, which in turn results in an increase in the voltage $V_{OUT}$. The increase in the voltage $V_{OUT}$ increases the tail voltages of the LED strings 105-107, and thus increases the minimum tail voltage $V_{Tmin}$. As the code $C_{min_min}$ is generated, via the ADC 134, from the minimum tail voltage $V_{Tmin}$, the increase in the minimum tail voltage $V_{Tmin}$ results in an increase in the code $C_{min_min}$. Accordingly, the LCM 136 compares the actual code $C_{min_min}$ resulting from the predetermined increase in the code $C_{reg}$ with an expected code $C_{min_min}$ for the predetermined increase to determine the deviation between the expected response of the feedback mechanism and the actual response. From this deviation the LCM 136 can determine a feedback compensation factor 142 representing an adjustment factor for the feedback loop. The LCM 136 then provides the feedback compensation factor 142 to the code processing module 120 for implementation in determining codes $C_{reg}$ from incoming codes $C_{min_min}$ during normal operation.

The data/timing control module 128 receives the PWM data 111 and is configured to provide control signals to the other components of the LED driver 104 based on the timing and activation information represented by the PWM data 111. To illustrate, the data/timing control module 128 provides control signals $C_1$, $C_2$, and $C_n$ to the current control modules 125, 126, and 127, respectively, to control which of the LED strings 105-107 are active during corresponding portions of their respective PWM cycles. The data/timing control module 128 also provides control signals to the code generation module 118, the code processing module 120, and the control DAC 122 so as to control the operation and timing of these components. Further, in one embodiment, the data/timing control module 128 provides a steady state (SS) signal 144 that signals to the LCM 136 whether there has been a change in the utilization of the LED strings 105-107 (i.e., a change in the display lighting provided by the LED strings 105-107). As a change in the utilization of the LED strings 105-107 typically is signaled by a change in the duty ratio of the PWM cycles of the PWM data 111, in one embodiment, the data/timing control module 128 monitors the duty cycle of the PWM data 111 and asserts the SS signal 144 whenever the duty cycle changes. The data/timing control module 128 can be implemented as hardware, software executed by one or more processors, or a combination thereof. To illustrate, the data/timing control module 128 can be implemented as a logic-based hardware state machine.

Figure 2:
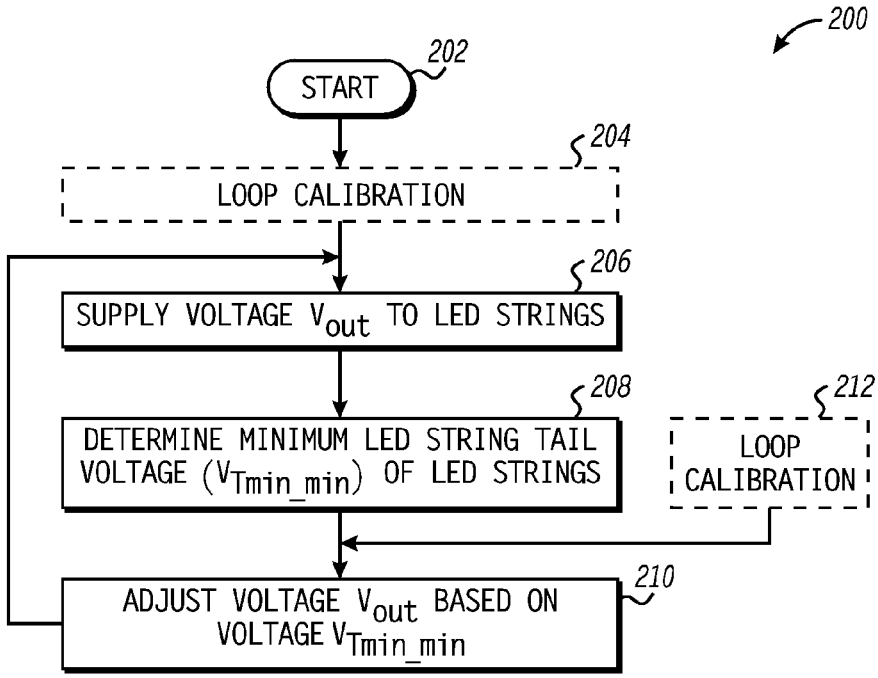
FIG. 2 is a flow diagram illustrating a method of operation of the LED system of FIG. 1 in accordance with at least one embodiment of the present disclosure.

FIG. 2 illustrates an example method 200 of operation of the LED system 100 in accordance with at least one embodiment of the present disclosure. At block 202, the LED system 100 enters a start-up mode from an initial application of power or from a power-on-reset. At block 204, the LED driver 104 can implement a loop calibration process at start up so as to determine a feedback compensation factor to compensate for deviations of the particular implementation of the LED driver 104.

After initial loop calibration, the LED driver 104 enters an operational mode whereby the LED display implementing the LED driver 104 and the LED strings 105-107 is used to display image content. Accordingly, at block 206, the voltage source 112 provides an initial output voltage $V_{OUT}$. As the PWM data for a given PWM cycle is received, the data/timing control module 128 configures the control signals $C_1$, $C_2$, and $C_n$ so as to selectively activate the LED strings 105-107 at the appropriate times of their respective PWM cycles. Over the course of the PWM cycle, the code generation module 118 determines the minimum detected tail voltage ($V_{Tmin_min}$) for the LED tails 105-107 for the PWM cycle at block 208. At block 210, the feedback controller 114 configures the signal ADJ based on the voltage $V_{Tmin_min}$ to adjust the output voltage $V_{OUT}$, which in turn adjusts the tail voltages of the LED strings 105-107 so that the minimum tail voltage $V_{Tmin}$ of the LED strings 105-107 is closer to a predetermined threshold voltage. The process of blocks 206-210 can be repeated for the next PWM cycle, and so forth.

As a non-zero tail voltage for a LED string indicates that more power is being used to drive the LED string than is absolutely necessary, it typically is advantageous for power consumption purposes for the feedback controller 114 to manipulate the voltage source 112 to adjust the output voltage $V_{OUT}$ until the minimum tail voltage $V_{Tmin_min}$ would be approximately zero, thereby eliminating nearly all excess power consumption that can be eliminated without disturbing the proper operation of the LED strings. Accordingly, the feedback controller 114 configures the signal ADJ so as to reduce the output voltage $V_{OUT}$ by an amount expected to cause the minimum tail voltage $V_{Tmin_min}$ of the LED strings 105-107 to be at or near zero volts.

However, while being advantageous from a power consumption standpoint, having a near-zero tail voltage on a LED string introduces potential problems. As one issue, the current regulators 115-117 may need non-zero tail voltages or headroom voltages to operate properly. Further, it will be appreciated that a near-zero tail voltage provides little or no margin for spurious increases in the bias voltage needed to drive the LED string resulting from self-heating or other dynamic influences on the LEDs 108 of the LED strings 105-107. Accordingly, in at least one embodiment, the feedback controller 114 can achieve a suitable compromise between reduction of power consumption and the response time of the LED driver 104 by adjusting the output voltage $V_{OUT}$ so that the expected minimum tail voltage of the LED strings 105-107 or the expected minimum headroom voltage for the related current regulators 115-117 is maintained at or near a non-zero threshold voltage $V_{thresh}$ that represents an acceptable compromise between LED current regulation, PWM response time, and reduced power consumption. The threshold voltage $V_{thresh}$ can be implemented as, for example, a voltage between 0.1 V and 1 V (e.g., 0.5 V).

In at least one embodiment, the degree to which the feedback controller 114 adjusts the output voltage $V_{OUT}$ via the ADJ signal at block 210 is modulated by the feedback compensation factor 142 determined during the loop calibration process. As noted above, the loop calibration process can be performed during start-up of the LED system 100 at block 204. The loop calibration process also can be performed dynamically or in real-time during operational mode of the LED system 100 at block 212, in addition to or in place of the initial loop calibration process of block 204. To illustrate, in certain implementations it may be expected that the feedback loop will not change dynamically during normal operation and thus it may be sufficient to determine the loop calibration process only in the start-up mode at block 204. In other instances, temperature conditions and degradation of the components of the LED system 100 may have the potential to alter the characteristics of the feedback mechanism and thus the loop calibration process may be performed dynamically during the operational mode of the LED system 100 at block 212. Examples of the initial loop calibration process of block 204 and the dynamic loop calibration process of block 212 are discussed in detail below with reference to FIGS. 12 and 13, respectively.

Figure 3:
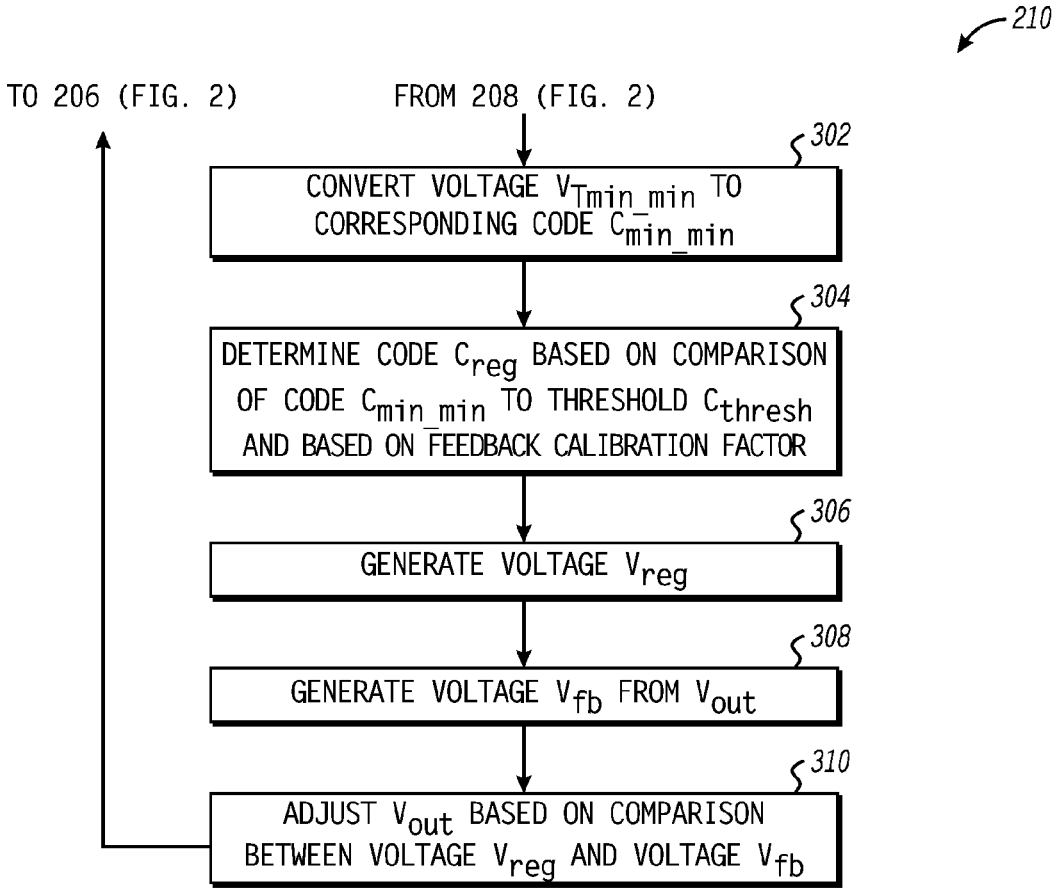
FIG. 3 is a flow diagram illustrating the method of FIG. 2 in greater detail in accordance with at least one embodiment of the present invention.

FIG. 3 illustrates a particular implementation of the process represented by block 210 of the method 200 of FIG. 2 in accordance with at least one embodiment of the present disclosure. As described above, at block 208 (FIG. 2) of the method 200, the code generation module 118 monitors the tail voltages $V_{T1}$, $V_{T2}$, and $V_{Tn}$ of the LED tails 105-107 to identify the minimum detected tail voltage $V_{Tmin_min}$ for the PWM cycle. Following at block 302, the code generation module 118 converts the voltage $V_{Tmin_min}$ to a corresponding digital code value $C_{min_min}$. Thus, the code value $C_{min_min}$ is a digital value representing the minimum tail voltage $V_{Tmin_min}$ detected during the PWM cycle. As described in greater detail herein, the detection of the minimum tail voltage $V_{Tmin_min}$ can be determined in the analog domain and then converted to a digital value, or the detection of the minimum tail voltage $V_{Tmin_min}$ can be determined in the digital domain based on the identification of the minimum code value $C_{min_min}$ from a plurality of code values $C_{min}$ representing the minimum tail voltage $V_{Tmin}$ at various points over the PWM cycle.

At block 304, the code processing module 120 compares the code value $C_{min_min}$ with a code value $C_{thresh}$ to determine the relationship of the minimum tail voltage $V_{Tmin_min}$ (represented by the code value $C_{min_min}$) to the threshold voltage $V_{thresh}$ (represented by the code value $C_{thresh}$). As described above, the feedback controller 114 is configured to control the voltage source 112 so as to maintain the minimum tail voltage of the LED strings 105-107 at or near a threshold voltage $V_{thresh}$ during the corresponding PWM cycle. The voltage $V_{thresh}$ can be at or near zero volts to maximize the reduction in power consumption or it can be a non-zero voltage (e.g., 0.5 V) so as to comply with PWM performance requirements and current regulation requirements while still reducing power consumption.

The code processing module 120 generates a code value $C_{reg}$ based on the relationship of the minimum tail voltage $V_{Tmin_min}$ to the threshold voltage $V_{thresh}$ revealed by the comparison of the code value $C_{min_min}$ to the code value $C_{thresh}$. As described herein, the value of the code value $C_{reg}$ affects the resulting change in the output voltage $V_{OUT}$. Thus, when the code value $C_{min_min}$ is greater than the code value $C_{thresh}$, a value for $C_{reg}$ is generated so as to reduce the output voltage $V_{OUT}$, which in turn is expected to reduce the minimum tail voltage $V_{Tmin}$ closer to the threshold voltage $V_{thresh}$. To illustrate, the code processing module 120 compares the code value $C_{min_min}$ to the code value $C_{thresh}$. If the code value $C_{min_min}$ is less than the code value $C_{thresh}$, an updated value for $C_{reg}$ is generated so as to increase the output voltage $V_{OUT}$, which in turn is expected to increase the minimum tail voltage $V_{Tmin_min}$ closer to the threshold voltage $V_{thresh}$. Conversely, if the code value $C_{min_min}$ is greater than the code value $C_{thresh}$, an updated value for $C_{reg}$ is generated so as to decrease the output voltage $V_{OUT}$, which in turn is expected to decrease the minimum tail voltage $V_{Tmin_min}$ closer to the threshold voltage $V_{thresh}$. To illustrate, the updated value for $C_{reg}$ can be set to $$C_{reg}(\text{updated})=C_{reg}(\text{current})+\text{offset1} \quad \text{EQ. 1}$$

$$offset1 = \frac{R_{f2}}{R_{f1}+R_{f2}} \times \frac{(C_{thresh}-C_{min_min})}{\text{Gain_ADC}\times\text{Gain_DAC}} \quad \text{EQ. 2}$$

whereby $R_{f1}$ and $R_{f2}$ represent the resistance values of the resistor 128 and the resistor 130, respectively, of the voltage divider 126 and Gain_ADC represents the gain of the ADC (in units code per volt) and Gain_DAC represents the gain of the control DAC 122 (in unit of volts per code). Depending on the relationship between the voltage $V_{Tmin_min}$ and the voltage $V_{thresh}$ (or the code value $C_{min_min}$ and the code value $C_{thresh}$), the offset1 value can be either positive or negative.

Alternately, when the code $C_{min_min}$ indicates that the minimum tail voltage $V_{Tmin_min}$ is at or near zero volts (e.g., $C_{min_min}=0$) the value for updated $C_{reg}$ can be set to $$C_{reg}(\text{updated})=C_{reg}(\text{current})+\text{offset2} \quad \text{EQ. 3}$$

whereby offset2 corresponds to a predetermined voltage increase in the output voltage $V_{OUT}$ (e.g., 1 V increase) so as to affect a greater increase in the minimum tail voltage $V_{Tmin_min}$.

EQs. 1-3 illustrate that the generation of the code value $C_{reg}$ is dependent on the expected resistance values $R_{f1}$ and $R_{f2}$ of the resistors 128 and 130 of the voltage divider 126 (FIG. 1). However, as noted above, the actual ratio of the resistance values of the resistors 128 and 130 may differ from the expected ratio of resistance values, and thus the LCM 136 determines a feedback compensation factor (identified as herein as f(ADC/DAC)) that represents an adjustment or correction intended to compensate for this difference. In one embodiment, the code processing module 120 utilizes the feedback compensation factor as a scaling factor during the calculation of the code $C_{reg}$, whereby EQs. 2 and 3 are expanded to incorporate the feedback compensation factor thusly:

$$offset1 = \frac{R_{f2}}{R_{f1}+R_{f2}} \times \frac{(C_{thresh}-C_{min_min})}{\text{Gain_ADC}\times\text{Gain_DAC}} \times f(ADC/DAC) \quad \text{EQ. 4}$$

$$C_{reg}(\text{updated})=C_{reg}(\text{current})+(\text{offset2}\times f(ADC/DAC)) \quad \text{EQ. 5}$$

Although EQs. 4 and 5 illustrate one implementation of the feedback compensation factor as a scaling factor in adjusting the resulting code $C_{reg}$, the feedback compensation factor can be implemented in alternate ways without departing from the scope of the present disclosure. To illustrate, the feedback compensation factor can be implemented as an additive or subtractive component in addition to, or instead of, as a scaling component.

At block 306, the control DAC 122 converts the updated code value $C_{reg}$ to its corresponding updated regulation voltage $V_{reg}$. At block 308, the feedback voltage $V_{fb}$ is obtained from the voltage divider 126. At block 310, error amplifier 124 compares the voltage $V_{reg}$ and the voltage $V_{fb}$ and configures the signal ADJ so as to direct the voltage source 112 to increase or decrease the output voltage $V_{OUT}$ depending on the result of the comparison as described above. The process of blocks 302-310 can be repeated for the next PWM cycle, and so forth.

Figure 4:
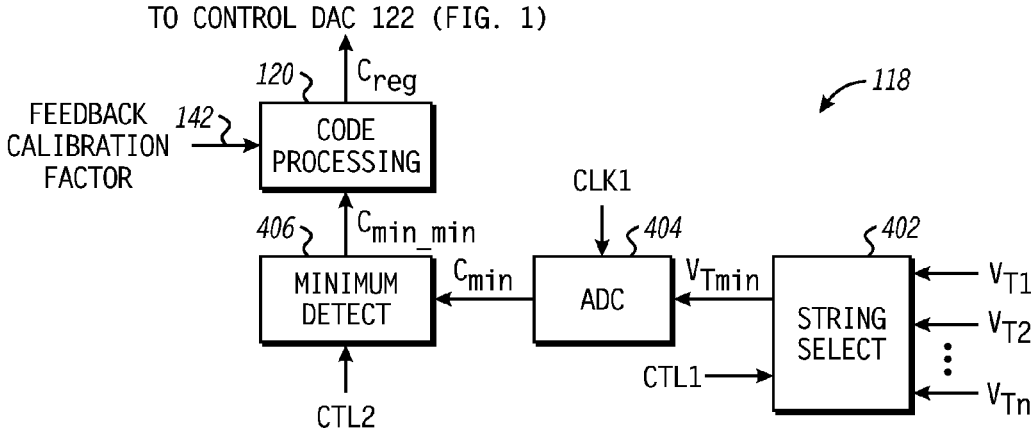
FIG. 4 is a diagram illustrating an example implementation of a feedback controller of the LED system of FIG. 1 in accordance with at least one embodiment of the present invention.

FIG. 4 illustrates a particular implementation of the code generation module 118 and the code processing module 120 of the LED driver 104 of FIG. 1 in accordance with at least one embodiment of the present disclosure. In the illustrated embodiment, the code generation module 118 includes an analog string select module 402 (corresponding to the string select module 130, FIG. 1), an analog-to-digital converter (ADC) 404 (corresponding to the ADC 134, FIG. 1), and a digital minimum detect module 406 (corresponding to the minimum detect module 132, FIG. 1). The analog string select module 402 includes a plurality of inputs coupled to the tail ends of the LED strings 105-107 (FIG. 1) so as to receive the tail voltages $V_{T1}$, $V_{T2}$, and $V_{Tn}$. In one embodiment, the analog string select module 402 is configured to provide the voltage $V_{Tmin}$ that is equal to or representative of the lowest tail voltage of the active LED strings at the corresponding point in time of the PWM cycle. That is, rather than supplying a single voltage value at the conclusion of a PWM cycle, the voltage $V_{Tmin}$ output by the analog string select module 402 varies throughout the PWM cycle as the minimum tail voltage of the LED strings changes at various points in time of the PWM cycle.

The analog string select module 402 can be implemented in any of a variety of manners. For example, the analog string select module 402 can be implemented as a plurality of semiconductor p-n junction diodes, each diode coupled in a reverse-polarity configuration between a corresponding tail voltage input and the output of the analog string select module 402 such that the output of the analog string select module 402 is always equal to the minimum tail voltage $V_{Tmin}$ where the offset from voltage drop of the diodes (e.g., 0.5 V or 0.7 V) can be compensated for using any of a variety of techniques.

The ADC 404 has an input coupled to the output of the analog string select module 402, an input to receive a clock signal CLK1, and an output to provide a sequence of code values $C_{min}$ over the course of the PWM cycle based on the magnitude of the minimum tail voltage $V_{Tmin}$ at respective points in time of the PWM cycle (as clocked by the clock signal CLK1). The number of code values $C_{min}$ generated over the course of the PWM cycle depends on the frequency of the clock signal CLK1. To illustrate, if the clock signal CLK1 has a frequency of 1000*CLK_PWM (where CLK_PWM is the frequency of the PWM cycle) and can convert the magnitude of the voltage $V_{Tmin}$ to a corresponding code value $C_{min}$ at a rate of one conversion per clock cycle, the ADC 404 can produce 1000 code values $C_{min}$ over the course of the PWM cycle.

The digital minimum detect module 406 receives the sequence of code values $C_{min}$ generated over the course of the PWM cycle by the ADC 404 and determines the minimum, or lowest, of these code values for the PWM cycle. To illustrate, the digital minimum detect module 406 can include, for example, a buffer, a comparator, and control logic configured to overwrite a code value $C_{min}$ stored in the buffer with an incoming code value $C_{min}$ if the incoming code value $C_{min}$ is less than the one in the buffer. The digital minimum detect module 406 provides the minimum code value $C_{min}$ of the series of code values $C_{min}$ for the PWM cycle as the code value $C_{min_min}$ to the code processing module 120. The code processing module 120 compares the code value $C_{min_min}$ to the predetermined code value $C_{thresh}$ and generates an updated code value $C_{reg}$ based on the comparison as described in greater detail above with reference to block 304 of FIG. 3.

Figure 5:
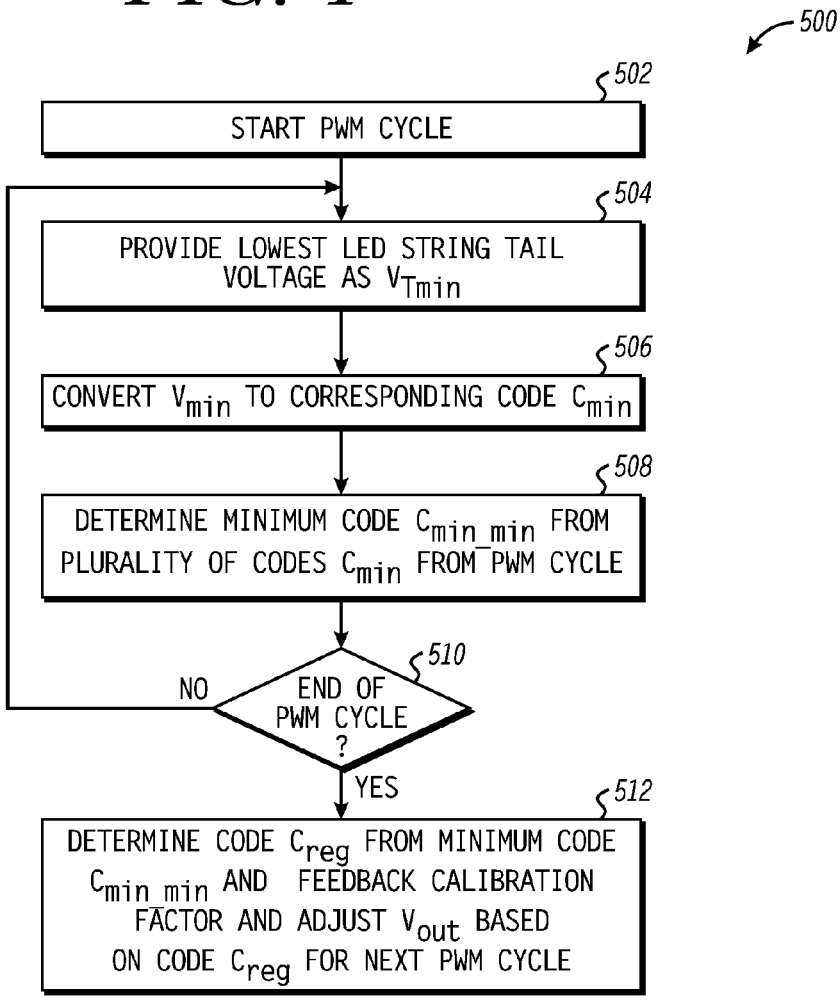
FIG. 5 is a flow diagram illustrating a method of operation of the example implementation of FIG. 4 in accordance with at least one embodiment of the present invention.

FIG. 5 illustrates an example method 500 of operation of the implementation of the LED system 100 illustrated in FIGS. 1 and 4 in accordance with at least one embodiment of the present disclosure. At block 502, a PWM cycle starts, as indicated by the received PWM data 111 (FIG. 1). At block 504, the analog string select module 402 provides the minimum tail voltage of the LED strings at a point in time of the PWM cycle as the voltage $V_{Tmin}$ for that point in time. At block 506, the ADC 404 converts the voltage $V_{Tmin}$ to a corresponding code value $C_{min}$ and provides it to the digital minimum detect 406 for consideration as the minimum code value $C_{min_min}$ for the PWM cycle thus far at block 508. At block 510, the data/timing control module 128 determines whether the end of the PWM cycle has been reached. If not, the process of blocks 504-508 is repeated to generate another code value $C_{min}$. Otherwise, if the PWM cycle has ended, the minimum code value $C_{min}$ of the plurality of code values $C_{min}$ generated during the PWM cycle is provided as the code value $C_{min_min}$ by the digital minimum detect module 406. In an alternate embodiment, the plurality of code values $C_{min}$ generated during the PWM cycle are buffered and then the minimum value $C_{min_min}$ is determined at the end of the PWM cycle from the plurality of buffered code values $C_{min}$. At block 512 the code processing module 120 uses the minimum code value $C_{min_min}$ and the feedback compensation factor 142 provided by the LCM 136 (FIG. 1) to generate an updated code value $C_{reg}$ based on a comparison of the code value $C_{min_min}$ to the predetermined code value $C_{thresh}$. The control DAC 122 uses the updated code value $C_{reg}$ to generate the corresponding voltage $V_{reg}$, which is used by the error amplifier 124 along with the voltage $V_{fb}$ to adjust the output voltage $V_{OUT}$ as described above.

Figure 6:
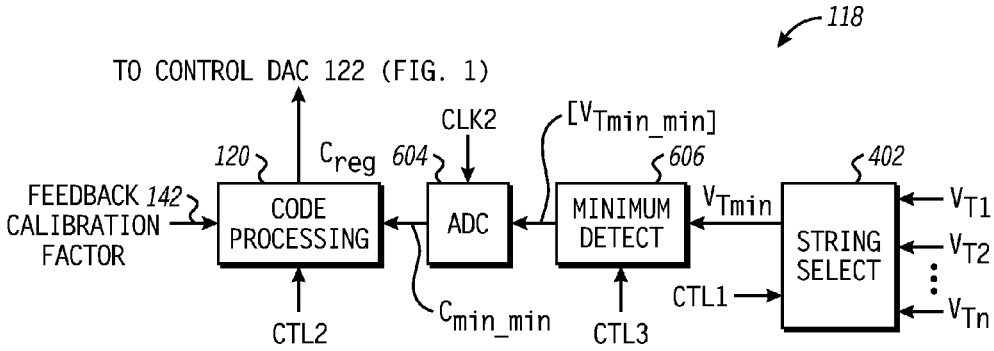
FIG. 6 is a diagram illustrating another example implementation of the feedback controller of the LED system of FIG. 1 in accordance with at least one embodiment of the present invention.

FIG. 6 illustrates another example implementation of the code generation module 118 and the code processing module 120 of the LED driver 104 of FIG. 1 in accordance with at least one embodiment of the present disclosure. In the illustrated embodiment, the code generation module 118 includes the analog string select module 402 as described above, an analog minimum detect module 606 (corresponding to the minimum detect module 132, FIG. 1), and an ADC 604 (corresponding to the ADC 134, FIG. 1). As described above, the analog string select module 402 continuously selects and outputs the minimum tail voltage of the LED strings 105-107 at any given time as the voltage $V_{Tmin}$ for that point in time. The analog minimum detect module 606 includes an input coupled to the output of the analog string select module 402, an input to receive a control signal CTL3 from the data/timing control module 128 (FIG. 1), where the control signal CTL3 signals the start and end of each PWM cycle. In at least one embodiment, the analog minimum detect module 606 detects the minimum voltage of the output of the analog string select module 402 over the course of a PWM cycle and outputs the minimum detected voltage as the minimum tail voltage $V_{Tmin_min}$.

The analog minimum detect module 606 can be implemented in any of a variety of manners. To illustrate, in one embodiment, the analog minimum detect module 606 can be implemented as a negative peak voltage detector that is accessed and then reset at the end of each PWM cycle. Alternately, the analog minimum detect module 606 can be implemented as a set of sample-and-hold circuits, a comparator, and control logic. One of the sample-and-hold circuits is used to sample and hold the voltage $V_{Tmin}$ and the comparator is used to compare the sampled voltage with a sampled voltage held in a second sample-and-hold circuit. If the voltage of the first sample-and-hold circuit is lower, the control logic switches to using the second sample-and-hold circuit for sampling the voltage $V_{Tmin}$ for comparison with the voltage held in the first sample-and-hold circuit, and so on.

The ADC 604 includes an input to receive the minimum tail voltage $V_{Tmin_min}$ for the corresponding PWM cycle and an input to receive a clock signal CLK2. The ADC 604 is configured to generate the code value $C_{min_min}$ representing the minimum tail voltage $V_{Tmin_min}$ and provide the code value $C_{min_min}$ to the code processing module 120, whereby it is compared with the predetermined code value $C_{thresh}$ to generate the appropriate code value $C_{reg}$ as described above.

Figure 7:
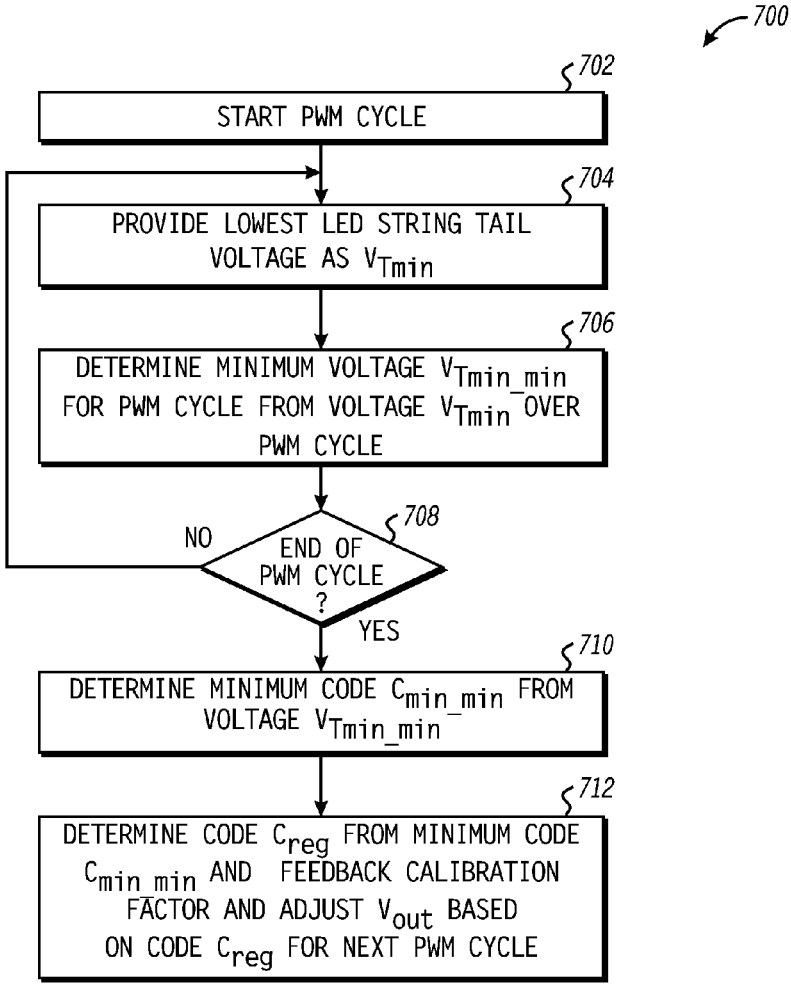
FIG. 7 is a flow diagram illustrating a method of operation of the example implementation of FIG. 6 in accordance with at least one embodiment of the present invention.

FIG. 7 illustrates an example method 700 of operation of the implementation of the LED system 100 illustrated in FIGS. 1 and 6 in accordance with at least one embodiment of the present disclosure. At block 702, a PWM cycle starts, as indicated by the received PWM data 111 (FIG. 1). At block 704, the analog string select module 402 provides the lowest tail voltage of the active LED strings at a given point in time of the PWM cycle as the voltage $V_{Tmin}$ for that point in time. At block 706, the minimum magnitude of the voltage $V_{Tmin}$ detected by the analog minimum detect module 606 is identified as the minimum tail voltage $V_{Tmin_min}$ for the PWM cycle thus far. At block 708, the data/timing control module 128 determines whether the end of the PWM cycle has been reached. If the PWM cycle has ended, the ADC 604 converts the minimum tail voltage $V_{Tmin_min}$ to the corresponding code value $C_{min_min}$. At block 712, the code processing module 120 converts the code value $C_{min_min}$ to an updated code value $C_{reg}$ based on a comparison of the code value $C_{min_min}$ to the predetermined code value $C_{thresh}$ and based on the feedback compensation factor 142 from the LCM 136 (FIG. 1). The control DAC 122 converts the updated code value $C_{reg}$ to the corresponding voltage $V_{reg}$, which is used by the error amplifier 124 along with the voltage $V_{fb}$ to adjust the output voltage $V_{OUT}$ as described above.

In the implementation of FIGS. 4 and 5, the voltage $V_{Tmin}$ output by the analog string select module 402 was converted into a sequence of code values $C_{min}$ based on the clock signal CLK1 and the sequence of code values $C_{min}$ was analyzed to determine the minimum code value of the sequence, and thus to determine the code value $C_{min_min}$ representative of the minimum tail voltage $V_{Tmin_min}$ occurring over a PWM cycle. Such an implementation requires an ADC 404 capable of operating with a high-frequency clock CLK1. The implementation of FIGS. 6 and 7 illustrates an alternate with relaxed ADC and clock frequency requirements because the minimum tail voltage $V_{Tmin_min}$ over a PWM cycle is determined in the analog domain and thus only a single analog-to-digital conversion is required from the ADC 604 per PWM cycle, at the cost of adding the analog minimum detect module 606.

Figure 8:
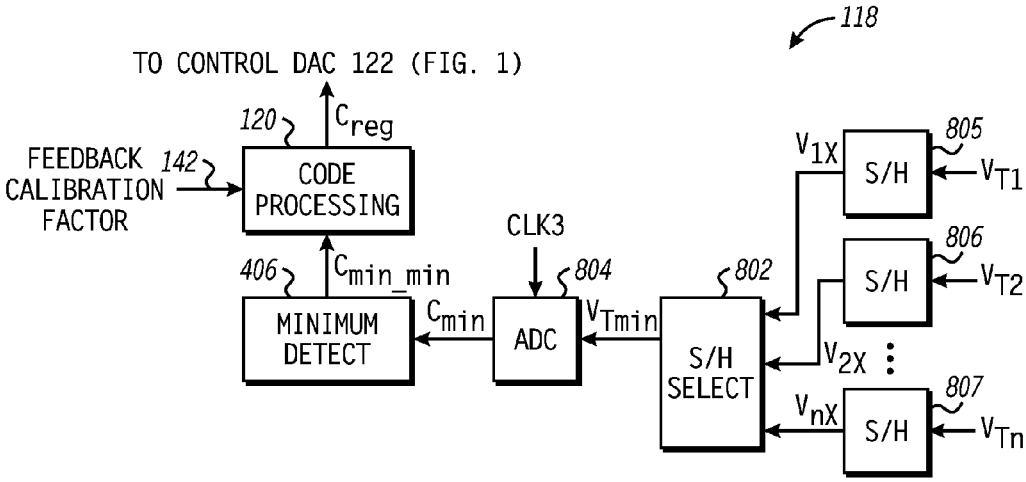
FIG. 8 is a diagram illustrating another example implementation of the feedback controller of the LED system of FIG. 1 in accordance with at least one embodiment of the present invention.

FIG. 8 illustrates yet another example implementation of the code generation module 118 and the code processing module 120 of the LED driver 104 of FIG. 1 in accordance with at least one embodiment of the present disclosure. In the illustrated embodiment, the code generation module 118 includes a plurality of sample-and-hold (S/H) circuits, such as S/H circuits 805, 806, and 807, a S/H select module 802 (corresponding to the string select module 130, FIG. 1), an ADC 804 (corresponding to the ADC 134, FIG. 1), and the digital minimum detect module 406 (described above).

Each of the S/H circuits 805-807 includes an input coupled to the tail end of a respective one of the LED strings 105-107 (FIG. 1) to receive the tail voltage of the LED string and an output to provide a sampled tail voltage of the respective LED string. In FIG. 8, the sampled voltages output by the S/H circuits 805-807 are identified as voltages $V_{1X}$, $V_{2X}$, and $V_{nX}$, respectively. In at least one embodiment, a control signal for a corresponding S/H circuit is enabled, thereby enabling sampling of the corresponding tail voltage, when the corresponding LED string is activated by a PWM pulse.

The S/H select module 802 includes a plurality of inputs to receive the sampled voltages $V_{1X}$, $V_{2X}$, and $V_{nX}$ and is configured to select the minimum, or lowest, of the sampled voltages $V_{1X}$, $V_{2X}$, and $V_{nX}$ at any given sample period for output as the voltage level of the voltage $V_{Tmin}$ for the sample point. The S/H select module 802 can be configured in a manner similar to the analog string select module 402 of FIGS. 4 and 6. The ADC 804 includes an input to receive the voltage $V_{Tmin}$ and an input to receive a clock signal CLK3. As similarly described above with respect to the ADC 404 of FIG. 4, the ADC 804 is configured to output a sequence of code values $C_{min}$ from the magnitude of the voltage $V_{Tmin}$ using the clock signal CLK3.

As described above, the digital minimum detect module 406 receives the stream of code values $C_{min}$ for a PWM cycle, determines the minimum code value of the stream, and provides the minimum code value as code value $C_{min_min}$ to the code processing module 120. The determination of the minimum code value $C_{min_min}$ can be updated as the PWM cycle progresses, or the stream of code values $C_{min}$ for the PWM cycle can be buffered and the minimum code value $C_{min_min}$ determined at the end of the PWM cycle from the buffered stream of code values $C_{min}$. The code processing module then compares the code value $C_{min_min}$ to the predetermined code value $C_{thresh}$ for the purpose of updating the code value $C_{reg}$.

Figure 9:
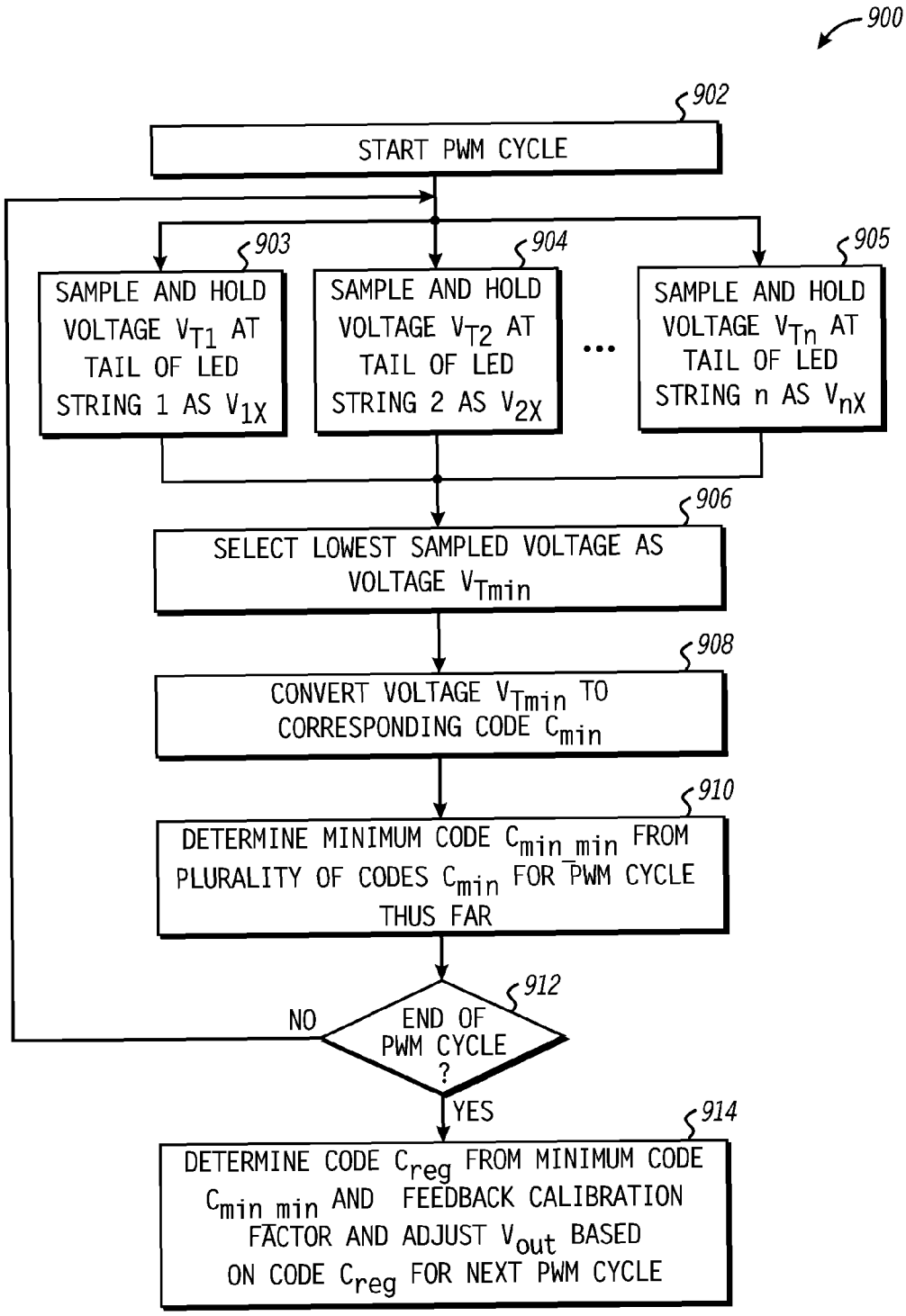
FIG. 9 is a flow diagram illustrating a method of operation of the example implementation of FIG. 8 in accordance with at least one embodiment of the present invention.

FIG. 9 illustrates an example method 900 of operation of the implementation of the LED system 100 illustrated in FIGS. 1 and 8 in accordance with at least one embodiment of the present disclosure. At block 902, a PWM cycle starts, as indicated by the received PWM data 111 (FIG. 1). At block 903, the S/H circuit 805 samples and holds the voltage level of the tail end of the LED string 105 as the voltage $V_{1X}$ when the LED string 105 (e.g., when activated by a PWM pulse). Likewise, at block 904 the S/H circuit 806 samples and holds the voltage level of the tail end of the LED string 106 as the voltage $V_{2X}$ when the LED string 106 is activated by a PWM pulse, and at block 905 the S/H circuit 807 samples and holds the voltage level of the tail end of the LED string 107 as the voltage $V_{nx}$ when the LED string 107 is activated by a PWM pulse.

At block 906, the S/H select module 802 selects the minimum of the sampled voltages $V_{1X}$, $V_{2X}$, and $V_{nX}$ for output as the voltage $V_{Tmin}$. At block 908, the ADC 804 converts the magnitude of the voltage $V_{Tmin}$ at the corresponding sample point to the corresponding code value $C_{min}$ and provides the code value $C_{min}$ to the digital minimum detect module 406. At block 910, the digital minimum detect module 406 determines the minimum code value of the plurality of code values $C_{min}$ generated during the PWM cycle thus far as the minimum code value $C_{min_min}$. At block 912, the data/timing control module 128 determines whether the end of the PWM cycle has been reached. If not, the process of blocks 903, 904, 905, 906, 908, and 910 is repeated to generate another code value $C_{min}$ and update the minimum code value $C_{min_min}$ as necessary. Otherwise, if the PWM cycle has ended, at block 914, the code processing module 120 converts the code value $C_{min_min}$ to an updated code value $C_{reg}$ based on a comparison of the code value $C_{min_min}$ to the predetermined code value $C_{thresh}$ and based on the feedback compensation factor 142 from the LCM 136 (FIG. 1). The control DAC 122 converts the updated code value $C_{reg}$ to the corresponding voltage $V_{reg}$, which is used by the error amplifier 124 along with the voltage $V_{fb}$ to adjust the output voltage $V_{OUT}$ as described above.

Figure 10:
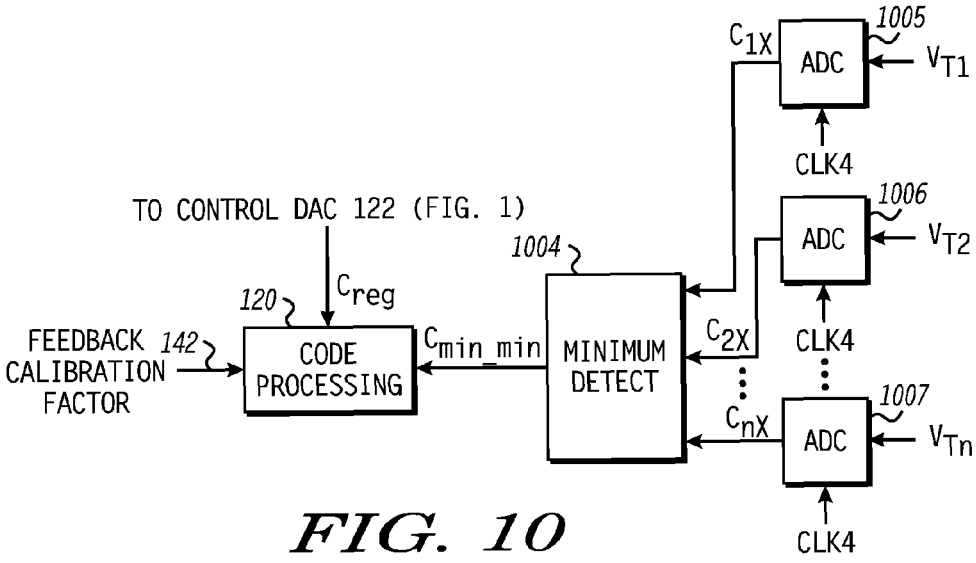
FIG. 10 is a diagram illustrating another example implementation of the feedback controller of the LED system of FIG. 1 in accordance with at least one embodiment of the present invention.

FIG. 10 illustrates another example implementation of the code generation module 118 and the code processing module 120 of the LED driver 104 of FIG. 1 in accordance with at least one embodiment of the present disclosure. In the illustrated embodiment, the code generation module 118 includes a plurality of ADCs, such as ADC 1005, ADC 1006, and ADC 1007 (corresponding to the ADC 134, FIG. 1) and a digital minimum detect module 1004 (corresponding to both the string select module 130 and the minimum detect module 132, FIG. 1).

Each of the ADCs 1005-1007 includes an input coupled to the tail end of a respective one of the LED strings 105-107 (FIG. 1) to receive the tail voltage of the LED string, an input to receive a clock signal CLK4, and an output to provide a stream of code values generated from the input tail voltage. In FIG. 10, the code values output by the ADCs 1005-1007 are identified as code values $C_{1X}$, $C_{2X}$, and $C_{nX}$, respectively.

The digital minimum detect module 1004 includes an input for each of the stream of code values output by the ADCs 1005-1007 and is configured to determine the minimum, or lowest, code value from all of the streams of code values for a PWM cycle. In one embodiment, the minimum code value for each LED string for the PWM cycle is determined and then the minimum code value $C_{min_min}$ is determined from the minimum code value for each LED string. In another embodiment, the minimum code value of each LED string is determined at each sample point (e.g., the minimum of $C_{1X}$, $C_{2X}$, and $C_{nX}$ at the sample point). The code processing module 120 then compares the code value $C_{min_min}$ to the predetermined code value $C_{thresh}$ for the purpose of updating the code value $C_{reg}$.

Figure 11:
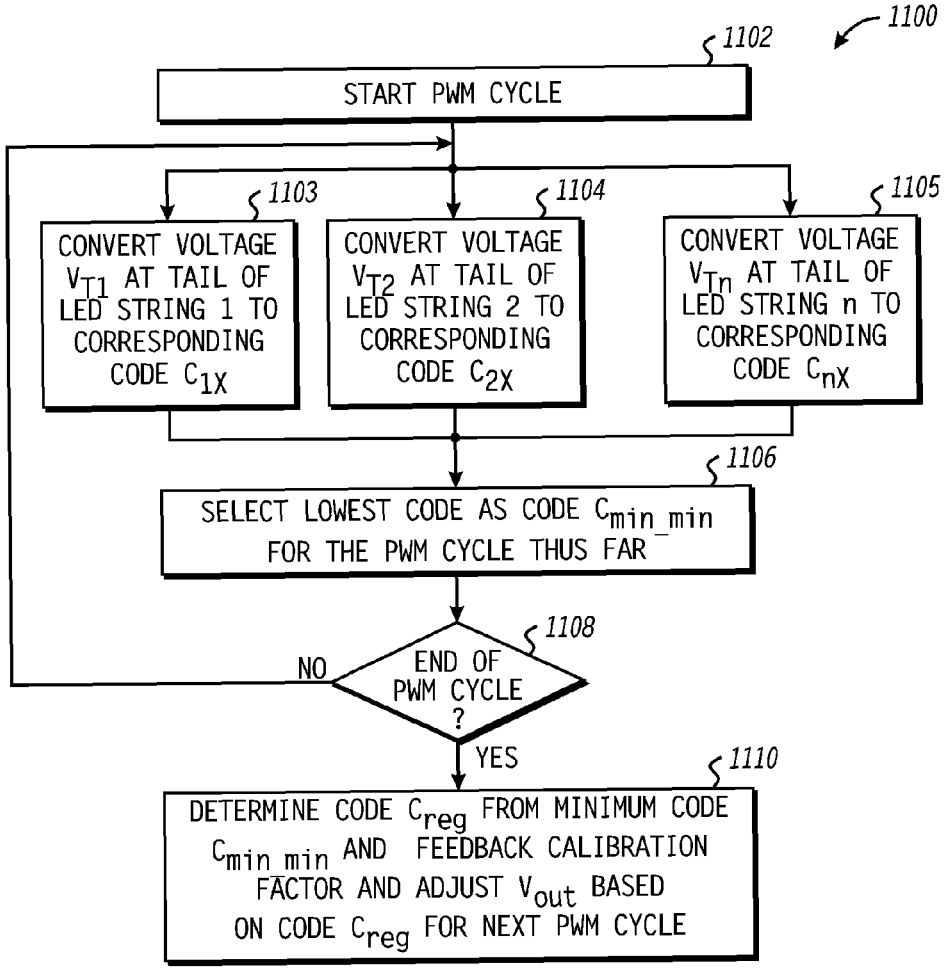
FIG. 11 is a flow diagram illustrating a method of operation of the example implementation of FIG. 10 in accordance with at least one embodiment of the present invention.

FIG. 11 illustrates an example method 1100 of operation of the implementation of the LED system 100 illustrated in FIGS. 1 and 10 in accordance with at least one embodiment of the present disclosure. At block 1102, a PWM cycle starts, as indicated by the received PWM data 111 (FIG. 1). At block 1103, the ADC 1005 converts the voltage $V_{T1}$ at the tail end of the LED string 105 to a corresponding code value $C_{1X}$ when the LED string 105 (e.g., when activated by a PWM pulse). Likewise, at block 1004 the ADC 1006 converts the voltage $V_{T2}$ at the tail end of the LED string 106 to a corresponding code value $C_{2X}$ when the LED string 106 is activated by a PWM pulse, and at block 1005 the ADC 1007 converts the voltage $V_{Tn}$ at the tail end of the LED string 107 to a corresponding code value $C_{nX}$ when the LED string 107 is activated by a PWM pulse.

At block 1106, the digital minimum detect module 1004 determines the minimum code value $C_{min_min}$ of the plurality of code values generated during the PWM cycle thus far, or, in an alternate embodiment, at the end of the PWM cycle from the code values generated over the entire PWM cycle. At block 1108, the data/timing control module 128 determines whether the end of the PWM cycle has been reached. If not, the process of blocks 1103, 1104, 1105, 1106, and 1108 is repeated to generate another set of code values from the tail voltages of the active LED strings and update the minimum code value $C_{min_min}$ as necessary. Otherwise, if the PWM cycle has ended, at block 1110, the code processing module 120 converts the code value $C_{min_min}$ to an updated code value $C_{reg}$ based on a comparison of the code value $C_{min_min}$ to the predetermined code value $C_{thresh}$ and based on the feedback compensation factor 142 from the LCM 136 (FIG. 1). The control DAC 122 converts the updated code value $C_{reg}$ to the corresponding voltage $V_{reg}$, which is used by the error amplifier 124 along with the voltage $V_{fb}$ to adjust the output voltage $V_{OUT}$ as described above.

Figure 12:
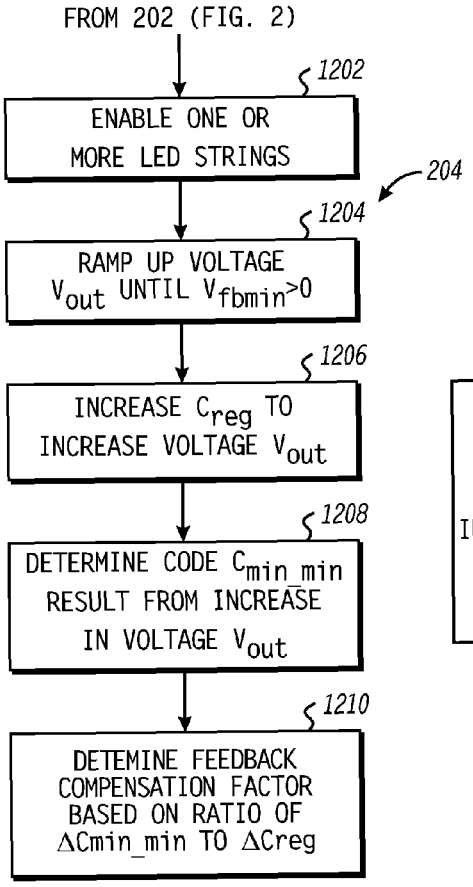
FIG. 12 is a flow diagram illustrating a method of determining a feedback compensation factor for calibrating the feedback mechanism of the LED system of FIG. 1 during a start-up of the LED system in accordance with at least one embodiment of the present invention.

FIG. 12 illustrates an example implementation of the initial loop calibration process of block 204 of method 200 of FIG. 2 in accordance with at least one embodiment of the present disclosure. As discussed above, the initial loop calibration process can be initiated for the start-up mode of the LED system 100 and prior to entering the operational mode. To initiate the calibration process, at block 1202 the LCM 136 enables one or more of the LED strings 105-107, either by directly controlling the current regulators 115-117 or by signaling the data/timing control module 128 to control the current regulators 115-117. As display of actual display content has not yet started, this process of enabling LED strings for calibration purposes can produce a flash at the LED panel 102, which may be potentially distracting to a viewer. Accordingly, in one embodiment, the LCD filter of the LED panel 102 can be configured to an opaque state so as to block the flash from being output to the viewer. Alternately, a minimum number of LED strings (e.g., only one LED string) can be enabled and minimal current can be used to drive the LED string(s) so enabled to minimize the intensity of the flash.

With one or more LED strings enabled, at block 1204 the LCM 136 signals the code processing module 120 to increase the code $C_{reg}$ (and thereby increasing the output voltage $V_{OUT}$ in response) until the magnitude of the output voltage $V_{OUT}$ is such that the tail voltage(s) of the enabled LED string(s) are above 0 V or at other specified threshold (monitored by checking whether the code $C_{min_min}$ has become non-zero or above a specified value). When this condition is reached, at block 1206 the LCM 136 asserts the calibrate signal 140, in response to which the code processing module 120 stores the code $C_{reg}$ and code $C_{min_Cmin}$ as code $C_{reg_0}$ and code $C_{min_min_0}$, respectively, and then performs a "soft-start" so as to ramp the code $C_{reg}$ to a predetermined value or by a predetermined amount such that $C_{reg}=C_{reg_1}$. The predetermined value for the code $C_{reg}$ or the predetermined amount by which the current code $C_{reg}$ is incremented can be conveyed as part of the calibrate signal 140, programmed via a register or via a resister-specific voltage, hardcoded in the code processing module 120, and the like. The new value for the code $C_{reg}$ ($C_{reg_1}$) results in an increase in the output voltage $V_{OUT}$. The LCM 136 waits for a time sufficient to permit this increase in the output voltage $V_{OUT}$ to propagate back to the feedback controller 114 at which time the LCM 136 determines the code $C_{min_min}$ that the feedback controller 114 generates as a result of the increase in the output voltage $V_{OUT}$. This resulting code value is stored as $C_{min_min_1}$.

At block 1210 the LCM 136 determines the feedback compensation factor based on the relationship between the predetermined increase in the code $C_{reg}$ (or the predetermined value for the code $C_{reg}$) and the resulting value of code $C_{min_min}$. In one embodiment, this relationship is represented as the ratio of the change in the value of the code $C_{min_min}$ to the change in the value of the code $C_{reg}$ and thus the feedback compensation factor (f(ADC/DAC)) can be calculated based on the difference between the expected ratio and the actual ratio as:

$$f(ADC/DAC) = \frac{\Delta C_{reg}}{\Delta C_{min_min}}(\text{actual}) \Big/ \frac{\Delta C_{reg}}{\Delta C_{min_min}}(\text{expected}) \qquad \text{EQ. 6}$$

Because $\Delta C_{reg}$ (actual)=$\Delta C_{reg}$ (expected), EQ.6 becomes:

$$f(ADC/DAC) = \frac{\Delta C_{min_min}(\text{expected})}{\Delta C_{min_min}(\text{actual})} \qquad \text{EQ. 7}$$

Although an example relationship between the stimulus of the change in the code $C_{reg}$ and the response of the resulting change in the code $C_{min_min}$ are discussed, other ways of representing this relationship can be implemented without departing from the scope of the present disclosure. To illustrate rather than expressing the relationship as a ratio of the change in the code $C_{min_min}$ to the change in the code $C_{reg}$, the inverse of this relationship instead can be implemented to determined the feedback compensation factor (with corresponding changes to the use of the feedback compensation factor in adjusting subsequent values for the code $C_{reg}$).

Figure 13:
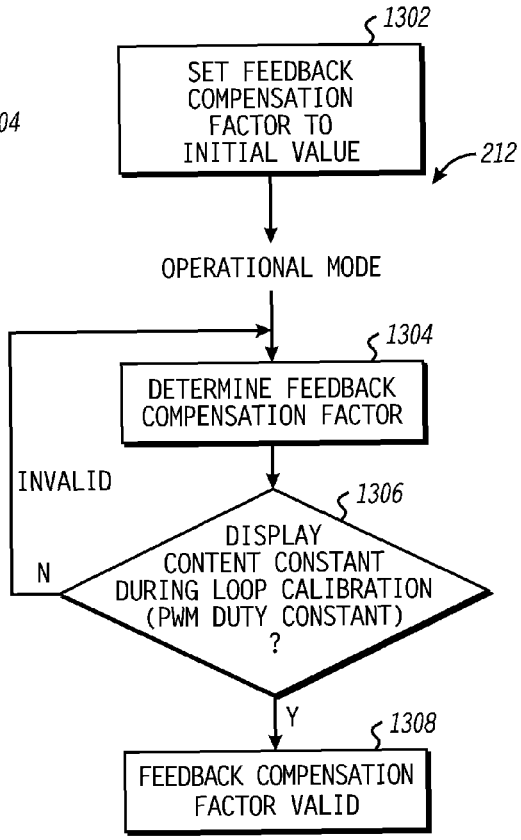
FIG. 13 is a flow diagram illustrating a method of determining a feedback compensation factor for calibrating the feedback mechanism of the LED system of FIG. 1 during a real-time operation of the LED system in accordance with at least one embodiment of the present invention.

FIG. 13 illustrates an example implementation of the dynamic loop calibration process of block 212 of method 200 of FIG. 2 in accordance with at least one embodiment of the present disclosure. The dynamic loop calibration process can implemented to adjust for dynamic changes in the LED system 100 in the operational mode during which image data is displayed. At block 1302, the LCM 136 sets the feedback compensation factor 142 to an initial value. This initial value can include, for example, the feedback compensation factor determined via the initial calibration process of block 204 (FIG. 2). Alternately, the initial value of the feedback compensation factor 142 can include a predetermined value, or the code processing module 120 can be configured to disable use of the feedback compensation factor 142 at block 1302.

When the LED driver 104 has entered the operational mode, at block 1304 the LCM 136 dynamically determines the feedback compensation factor 142 from the operation of the feedback controller 114 during display of the image data. In one embodiment, the LCM 136 determines the feedback compensation factor 142 in a manner similar to the one described in FIG. 12 whereby the LCM 136 signals the code processing module 120 to increment the current value of the code $C_{reg}$ by a predetermined amount and then determines the feedback compensation factor 142 from the change in the code $C_{min_min}$ resulting from the increment in the code $C_{reg}$. In another embodiment, rather than actively incrementing the code $C_{reg}$ the LCM 136 instead can wait for a change in the code $C_{reg}$ to occur as a result of normal operation and then observe the resulting code $C_{min_min}$.

A change in the display content of the image being displayed in conjunction with the LED panel 102 (i.e., a frame change) can change the utilization of the LED strings 105-107 (i.e., change the particular combination of LED strings that are enabled). This change in utilization of the LED strings 105-107 can result in a change in the particular minimum tail voltage $V_{Tmin_min}$ from which the code $C_{min_min}$ is generated. Thus, a change in the LED string utilization during the dynamic calibration process will render the resulting code $C_{min_min}$ unreliable because it potentially does not accurately reflect the relationship between an increase in the code $C_{reg}$ and the resulting increase in the code $C_{min_min}$. Accordingly, while the LCM 136 is performing the process of determining the feedback compensation factor at block 1306, the LCM 136 determines whether there has been a change in the LED string utilization while conducting the calibration process, and thus invalidating any results of the calibration process. As described above, the data/timing control module 128 monitors the duty cycles of the PWM data 111 and asserts the SS signal 144 in response to detecting a change in a duty cycle. As a change in duty cycle signals a change in the display lighting, the LCM 136 can use the SS signal 144 to determine whether the LED string utilization has held constant while conducting the dynamic calibration process. If not, the dynamic calibration process is halted, the results invalidated, and a new calibration process is initiated again at block 1304. If the display lighting has held constant (i.e., the LED string utilization has been constant), at block 1308 the LCM 136 identifies the results as valid and stores the resulting feedback compensation factor in a storage component (e.g., a register, non-volatile memory, etc.) for use by the code processing module 120 as the feedback compensation factor 142 for adjusting the code $C_{reg}$ as described above.

Figure 14:
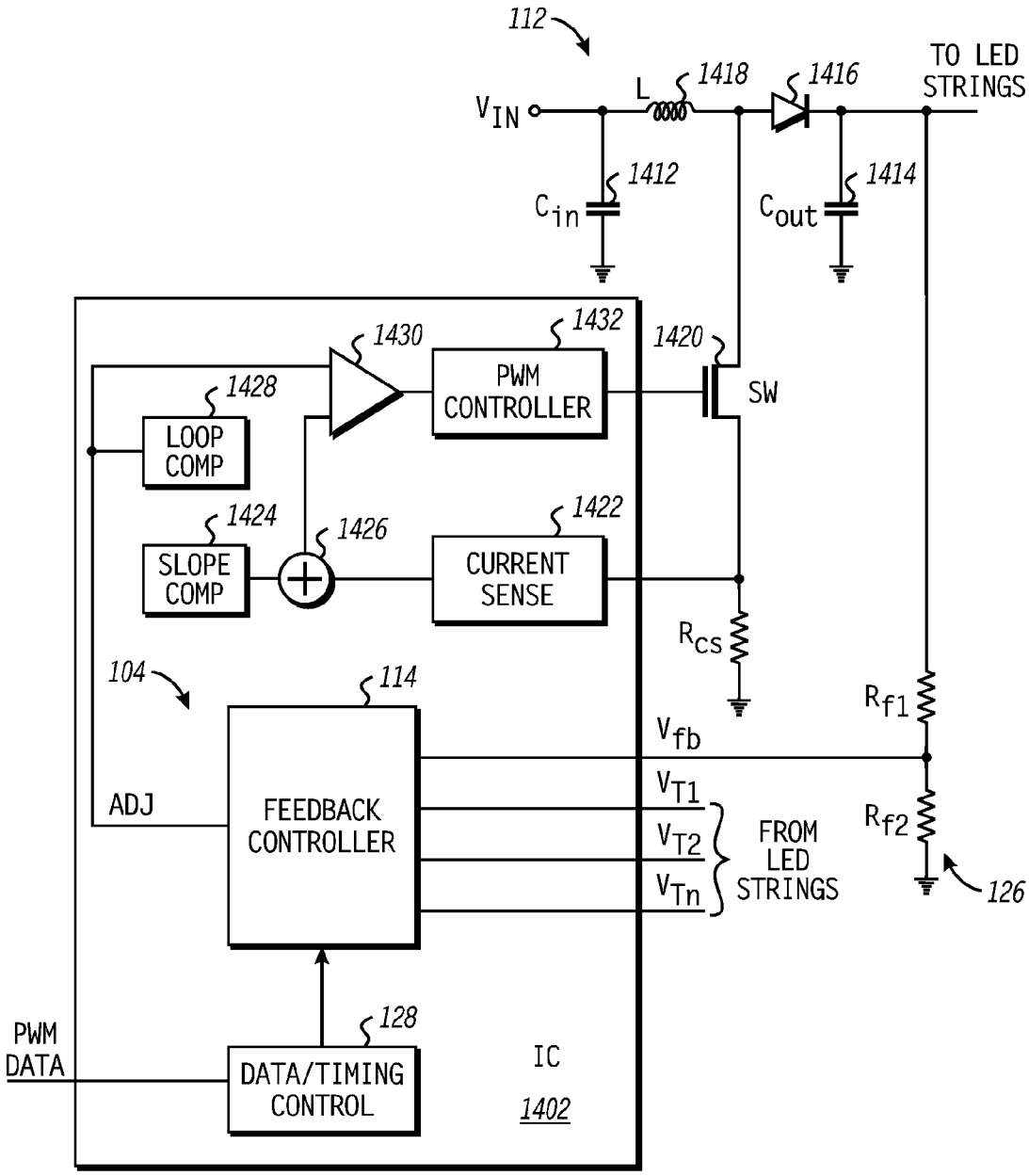
FIG. 14 is a diagram illustrating an integrated circuit (IC)-based implementation of the LED system of FIG. 1 in accordance with at least one embodiment of the present invention.

FIG. 14 illustrates an IC-based implementation of the LED system 100 of FIG. 1 as well as an example implementation of the voltage source 112 in accordance with at least one embodiment of the present disclosure. In the depicted example, the LED driver 104 is implemented as an integrated circuit (IC) 1402 having the data/timing control module 128 and the feedback controller 114. As also illustrated, some or all of the components of the voltage source 112 can be implemented at the IC 1402. In one embodiment, the voltage source 112 can be implemented as a step-up boost converter, a buck-boost converter, and the like. To illustrate, the voltage source 112 can be implemented with an input capacitor 1412, an output capacitor 1414, a diode 1416, an inductor 1418, a switch 1420, a current sense block 1422, a slope compensator 1424, an adder 1426, a loop compensator 1428, a comparator 1430, and a PWM controller 1432 connected and configured as illustrated in FIG. 14.

Other embodiments, uses, and advantages of the disclosure will be apparent to those skilled in the art from consideration of the specification and practice of the disclosure disclosed herein. The specification and drawings should be considered exemplary only, and the scope of the disclosure is accordingly intended to be limited only by the following claims and equivalents thereof.

What is claimed is:

1. A method comprising:

generating a first voltage based on a first digital code value;

providing a second voltage to a head end of each of a plurality of light emitting diode (LED) strings, each LED string having a corresponding tail voltage responsive to the second voltage, and the second voltage based on the first voltage;

determining a second digital code value representative of a first minimum tail voltage of the plurality of LED strings responsive to the second voltage;

determining a feedback compensation factor based on a relationship between the first digital code value and the second digital code value;

determining a third digital code value based on the feedback compensation factor;

generating a third voltage based on the third digital code value; and providing a fourth voltage to the head end of each of the plurality of LED strings, the fourth voltage based on the third voltage.

2. The method of claim 1, further comprising:

determining a fourth digital code value representative of a second minimum tail voltage of the plurality of LED strings responsive to the fourth voltage;

determining a fifth digital code value based on the fourth digital code value and the feedback compensation factor;

generating a fifth voltage based on the fifth digital code value; and providing a sixth voltage to the head end of each of the plurality of LED strings, the sixth voltage based on the fifth voltage.

3. The method of claim 1, wherein:

generating the first voltage comprises generating the first voltage via a digital-to-analog converter (DAC);

determining the second digital code value comprises determining the second digital code value via an analog-to-digital converter (ADC); and generating the third voltage comprises generating the third voltage via the DAC.

4. The method of claim 3, wherein:

providing the second voltage comprises generating the second voltage based on a relationship between the first voltage and a first voltage output of a voltage divider;

providing the fourth voltage comprises generating the fourth voltage based on a relationship between the third voltage and a second voltage output of the voltage divider; and wherein the DAC and the ADC are configured based on an expected resistance ratio of the voltage divider.

5. The method of claim 4, wherein the feedback compensation factor compensates for a difference between the expected resistance ratio and an actual resistance ratio of the voltage divider.

6. The method of claim 1, further comprising:

the relationship between the first digital code value and the second digital code value comprises a ratio of the first digital code value and the second digital code value; and determining the feedback compensation factor comprises determining the feedback compensation factor based on a difference between the ratio and an expected ratio.

7. The method of claim 1, further comprising:

generating the first digital code value based on a predetermined increase from a fourth digital code value, wherein the relationship between the first digital code value and the second digital code value comprises a ratio of the second digital code value and a difference between the first digital code value and the fourth digital code value; and determining the feedback compensation factor comprises determining the feedback compensation factor based on a difference between the ratio and an expected ratio.

8. The method of claim 1, further comprising:

operating a LED panel comprising the plurality of LED strings in a start-up mode and an operational mode, wherein image content is displayed via the LED panel in the operational mode; and wherein:

generating the first voltage comprises generating the first voltage in the start-up mode;

providing the second voltage comprises providing the second voltage in the start-up mode;

determining the second digital code value comprises determining the second digital code value in the start-up mode;

determining the feedback compensation factor comprises determining the feedback compensation factor in the operational mode;

determining the third digital code value comprises determining the third digital code value in the operational mode;

generating the third voltage comprises generating the third voltage in the operational mode; and providing the fourth voltage comprises providing the fourth voltage in the operational mode.

9. The method of claim 1, further comprising:

operating a LED panel comprising the plurality of LED strings in a start-up mode and an operational mode, wherein image content is displayed via the LED panel in the operational mode; and wherein:

generating the first voltage comprises generating the first voltage in the operational mode;

providing the second voltage comprises providing the second voltage in the operational mode;

determining the second digital code value comprises determining the second digital code value in the operational mode;

determining the feedback compensation factor comprises determining the feedback compensation factor in the operational mode;

determining the third digital code value comprises determining the third digital code value in the operational mode;

generating the third voltage comprises generating the third voltage in the operational mode; and providing the fourth voltage comprises providing the fourth voltage in the operational mode.

10. The method of claim 9, wherein determining the feedback compensation factor comprises determining the feedback compensation factor responsive to determining that a utilization of LED strings of the plurality of LED strings has remained constant between generating the first voltage and determining the second digital code value.

11. The method of claim 10, further comprising:

monitoring a duty cycle of a pulse width modulation (PWM) data used to control the LED strings to determine whether the utilization of LED strings has remained constant.

12. A system comprising:

a light emitting diode (LED) driver comprising:

a plurality of tail inputs, each tail input configured to couple to a tail end of a corresponding one of a plurality of light emitting diode (LED) strings; and a feedback controller comprising:

an analog-to-digital converter (ADC) configured to generate digital code values representative of corresponding minimum tail voltages of the plurality of LED strings;

a code processing module configured to, in a first mode, generate digital code values based on the digital code values generated by the ADC;

a digital-to-analog converter (DAC) configured to generate voltages based on the digital code values generated by the code processing module;

a loop calibration module configured to generate a feedback compensation factor based on a relationship between a digital code value generated by the code processing module and a resulting digital code value generated by the ADC; and the code processing module is configured to, in a second mode, generate digital code values based on digital code values generated by the ADC and based on the feedback compensation factor.

13. The system of claim 12, further comprising:

a voltage source configured to adjust an output voltage provided to a head end of each of the plurality of LED strings based on the voltages generated by the DAC.

14. The system of claim 13, further comprising:

a voltage divider configured to generate a voltage based on the output voltage of the voltage source;

wherein the voltage source is configured to adjust the output voltage based on a relationship between the voltage generated by the voltage divider and a voltage generated by the DAC; and wherein the DAC and the ADC are configured based on an expected resistance ratio of the voltage divider.

15. The system of claim 14, wherein the feedback compensation factor compensates for a difference between the expected resistance ratio and an actual resistance ratio of the voltage divider.

16. The system of claim 12, wherein:

a relationship between the digital code value generated by the code processing module and the resulting digital code value generated by the ADC comprises a ratio of the digital code value generated by the code processing module and the resulting digital code value generated by the ADC; and the loop calibration module is configured to determine the feedback compensation factor based on a difference between the ratio and an expected ratio.

17. The system of claim 12, wherein the loop calibration module is configured to determine the feedback compensation factor during a start-up mode.

18. The system of claim 12, wherein the loop calibration module is configured to determine the feedback compensation factor during an operational mode responsive to determining that a utilization of LED strings of the plurality of LED strings has remained constant between generation of the digital code value by the DAC and generation of the resulting digital code value by the ADC.

19. The system of claim 18, further comprising:

a data/timing control module configured to monitor a duty cycle of a pulse width modulation (PWM) data used to control the LED strings to determine whether the utilization of LED strings has remained constant.

20. The system of claim 12, further comprising:

a LED panel comprising the plurality of LED strings.

* * * * *